US009033009B2

(12) United States Patent
Peronto et al.

(10) Patent No.: US 9,033,009 B2
(45) Date of Patent: May 19, 2015

(54) METHOD FOR MECHANICALLY SCRAPING BOARDS, APPARATUS FOR SAME, AND PRODUCTS MADE THEREWITH

(75) Inventors: Robert J. Peronto, High Point, NC (US); Timothy C. Johnson, High Point, NC (US); Michael D. Compton, High Point, NC (US); Danny R. Smith, High Point, NC (US)

(73) Assignee: Mannington Mills, Inc., Salem, NJ (US)

( * ) Notice: Subject to any disclaimer, the term of this patent is extended or adjusted under 35 U.S.C. 154(b) by 1088 days.

(21) Appl. No.: 13/016,261

(22) Filed: Jan. 28, 2011

(65) Prior Publication Data

US 2011/0186180 A1 Aug. 4, 2011

Related U.S. Application Data

(60) Provisional application No. 61/299,740, filed on Jan. 29, 2010.

(51) Int. Cl.
*B27H 1/00* (2006.01)
*B27M 1/00* (2006.01)

(52) U.S. Cl.
CPC ..... *B27M 1/003* (2013.01)

(58) Field of Classification Search
CPC ..... B27M 1/003; B27M 1/006; B27G 1/00
USPC ..... 144/363, 367, 368, 369, 371, 372, 358; 451/5, 11, 57, 182, 184, 188
See application file for complete search history.

(56) References Cited

U.S. PATENT DOCUMENTS

| | | | |
|---|---|---|---|
| 3,756,295 | A | 9/1973 | Halop |
| 3,841,368 | A | 10/1974 | Ritter |
| 4,429,726 | A | 2/1984 | Betzler |
| 4,817,693 | A | 4/1989 | Schuler |
| 4,945,959 | A | 8/1990 | Biedenbach |
| 5,979,523 | A | 11/1999 | Puzio et al. |
| 6,027,289 | A | 2/2000 | Posh |
| 6,206,060 | B1 | 3/2001 | Blake |
| 6,736,042 | B2 | 5/2004 | Behne et al. |
| 2007/0209736 | A1 | 9/2007 | Deringor et al. |
| 2009/0159156 | A1 | 6/2009 | Walker |
| 2009/0277537 | A1 | 11/2009 | Hahn |

FOREIGN PATENT DOCUMENTS

CN 201366733 Y 12/2009

OTHER PUBLICATIONS

International Search Report and Written Opinion of the International Searching Authority issued in corresponding International Patent Application No. PCT/US2011/022936 dated May 5, 2011 (11 pages).
Office Action received in corresponding Chinese Patent Application No. 201180016065.X dated Jan. 24, 2014 (18 pages).

*Primary Examiner* — Shelley Self
*Assistant Examiner* — Matthew G Katcoff
(74) *Attorney, Agent, or Firm* — Kilyk & Bowersox, P.L.L.C.

(57) ABSTRACT

Methods are described for mechanically scraping surfaces of boards, such as flooring boards, to impart random-looking scraped profiles therein. An apparatus for mechanically scraping boards to form the scraped board products also is described. A board, such as a flooring board, having a random-looking scraped appearance that includes overlapping multiple scrape patterns is described. Boards, such as flooring boards, having a simulated rustic or distressed appearance made with the methods and apparatus also are described.

17 Claims, 25 Drawing Sheets

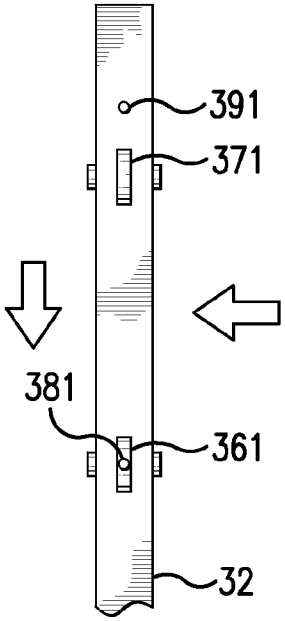
FIG. 10A
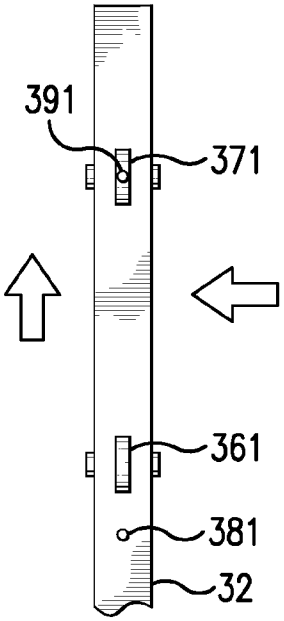
FIG. 10B
FIG. 10C
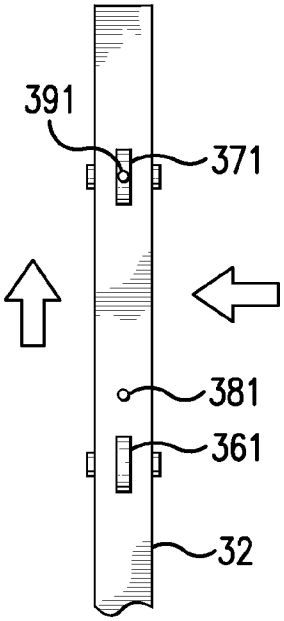
FIG. 10D

METHOD FOR MECHANICALLY SCRAPING BOARDS, APPARATUS FOR SAME, AND PRODUCTS MADE THEREWITH

This patent application claims the benefit of U.S. Provisional Patent Application No. 61/299,740 filed Jan. 29, 2010, and is incorporated in its entirety by reference herein.

BACKGROUND OF THE INVENTION

The present invention relates to methods for mechanically (e.g., automated) scraping surfaces of flooring boards or other boards to impart random-looking scraped patterns therein and scraped board products made therewith. The present invention also relates to an apparatus for mechanically scraping flooring boards or other boards to form the scraped board products. The present invention further relates to boards made from these processes.

Flooring products have been marketed having a simulated "rustic" or "distressed" appearance of a time worn hardwood floor. Time worn wooden flooring can have surface impressions reflecting wear and use, such as random grooves and gouges. These markings create a rustic or distressed surface appearance that has market appeal. Manual labor and hand tools have been used to scrape the face surface of new wood flooring boards to impart a simulated rustic or distressed look. A manual scraping process is time consuming and uneconomical for large scale production.

SUMMARY OF THE INVENTION

A feature of the present invention is to provide a method for mechanically forming a simulated rustic or distressed look in boards (e.g., flooring boards).

Another feature of the present invention is to provide a method for mechanically forming a simulated rustic or distressed look in boards (e.g., flooring boards) which is comparable to a manual scraped look without the required manual labor.

An additional feature of the present invention is to provide an apparatus for mechanically forming a simulated rustic or distressed look in boards (e.g., flooring boards).

A further feature of the present invention is to provide boards (e.g., flooring boards) imparted with a simulated rustic or distressed look having or including a random-looking scraped appearance.

Additional features and advantages of the present invention will be set forth in part in the description that follows, and in part will be apparent from the description, or can be learned by practice of the present invention. The objectives and other advantages of the present invention will be realized and attained by means of the elements and combinations particularly pointed out in the description and appended claims.

To achieve these and other advantages, and in accordance with various purposes of the present invention, as embodied and broadly described herein, the present invention relates to a method for imparting a simulated rustic or distressed surface effect in a board (e.g., flooring board) which includes advancing boards on a table, wherein the table has a board supporting surface and a plurality of slot openings in the board supporting surface through which one or more different rotary cutter heads having one or more different cutting profiles protrude to be contactable with lower surfaces of the boards advanced thereover. During advancement of the boards on the table, opposite lateral sides of the boards are engaged with a pair of laterally movable fences, and lower surfaces of the board are engaged with liftable bed plates which define the slot openings in the table. A fence moving device(s) is provided for laterally moving the fences relative to the cutter heads and also a servo motor for driving the fence moving device(s) under control of a programmable controller. Also, cam action devices also are provided for lifting bed plates relative to the cutter heads and also associated servo motors for driving the cam action devices under control of a programmable controller. The programmable controller is used to control the servo motors of the cam action devices and fence driving device to control the depth of cut and lateral cut position on the lower surface of boards, wherein different at least partial overlapping patterns of scrapes are formed in the lower surface of the boards by the different cutter heads. Use of the multiple cutter heads along the table that have different profiles, cut to different depths, and/or come into the cut at different frequencies relative to each other can allow for multiple cut patterns to be imparted to the lower surface of the board to breakup previous imparted scraped patterns. The overall profiling effect is to impart a random-looking scraped appearance in the board that simulates a time worn hardwood flooring surface. The method can further comprise board edge bevel cutting tool at a slot opening along the table and a servo motor driving the board edge bevel cutting tool for beveling opposite edges of the boards. The bevel cutting tool can be used to impart different bevel cuts on the opposite sides of the board wherein laterally adjacent bed plate lifters are provided which define the slot opening and are independently lifted relative to opposite board edges.

The present invention further relates to an apparatus for mechanically forming a simulated rustic or distressed look in boards (e.g., flooring boards). The apparatus includes:

a table comprising a board supporting surface and a plurality of slot openings in the board supporting surface;

first and second laterally movable fences for engaging opposite lateral sides of boards on the table;

a plurality of rotary cutter heads having one or more different cutting profiles and the cutter heads are positioned at different slot openings, wherein each cutter head is fixedly mounted to a rotatable drive spindle and the cutter head protrudes into the slot opening to be contactable with a lower surface of the boards advancing thereover;

liftable bed plates forming portions of the table that define the slot openings;

cam action devices for lifting the bed plates relative to the cutter heads;

a fence moving device(s) for laterally moving the fences relative to the cutter heads;

servo motors for driving the cam action devices and fence moving device(s);

a programmable controller; and feed rollers for advancing the boards down the table, wherein the programmable controller is operable for controlling the servo motors operable that, different and at least partial, overlapping patterns of scrapes are formed in the lower surface of the boards by the different cutter heads. The above-described bevel edge cutting tool and control also can be included in the apparatus.

The present invention also relates to boards (e.g., flooring boards) having a random-looking scraped appearance that includes overlapping multiple scrape patterns. The present invention further relates to boards (e.g., flooring boards) having a simulated rustic or distressed surface effect made by the above described methods.

For purposes herein, the terms "boards" and "planks" are used interchangeably.

It is to be understood that both the foregoing general description and the following detailed description are exemplary and explanatory only and are intended to provide a further explanation of the present invention, as claimed.

The accompanying drawings, which are incorporated in and constitute a part of this application, illustrate some of the embodiments of the present invention and together with the description, serve to explain the principles of the present invention. Similar features are labeled with similar identifying numbers.

BRIEF DESCRIPTION OF THE DRAWINGS

FIGS. 10A-10D shows a series of schematical plan views of the movements of one example of bed plate pins and steel bar bearings in correspondence to FIGS. 9A-9D in accordance with the present invention.

DETAILED DESCRIPTION OF THE PRESENT INVENTION

Figure 1:
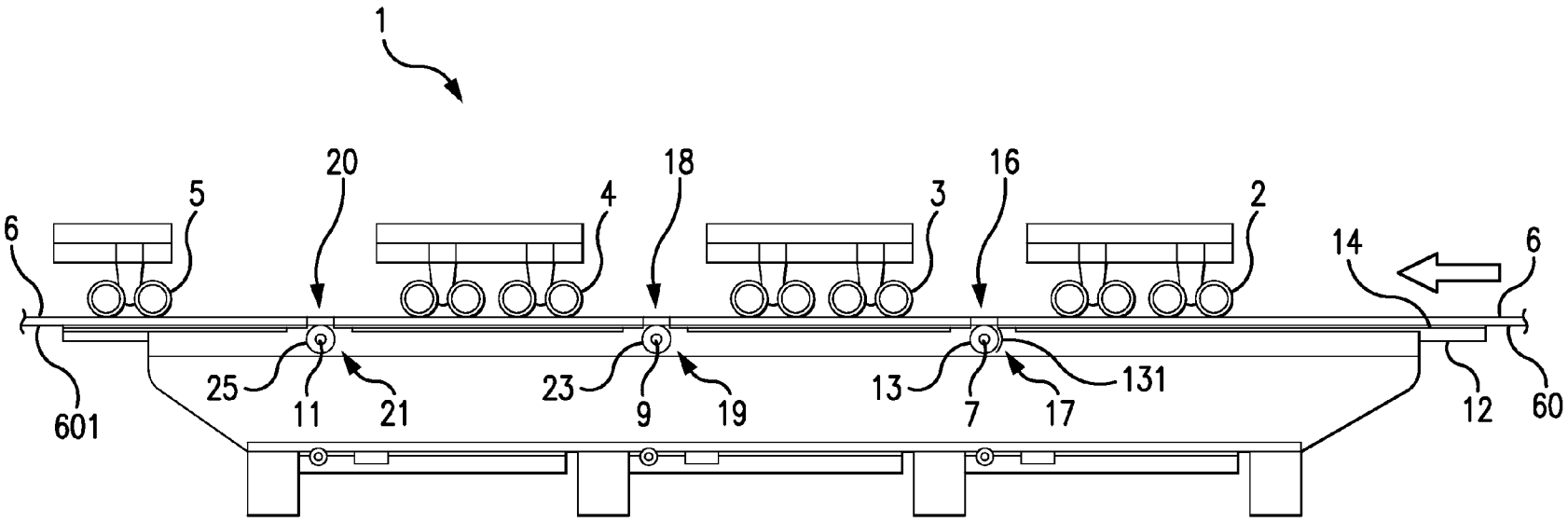
FIG. 1 shows a diagrammatic side elevational view of one example of a board scraping machine equipped with cutter heads in accordance with the present invention.

The present invention relates to reproducing the look of a time worn or hand scraped surface on the face of boards, such as flooring boards or boards using a mechanical apparatus operable under automated control. While floor boards are the preferred use, it is to be understood that the present invention, in all embodiments, can make boards in general, and can make boards for use in other applications, like wall boards, ceiling boards, building boards, and the like.

To impart a time worn or simulated hand scraped look to surfaces of boards, for instance, for flooring, a profiling method and apparatus are provided having machining stations arranged in a configuration that engages profiled knife planer heads with a surface of workpiece boards to carve ridges and valleys having a random-looking appearance into a face of the workpiece boards. The scraped surface usually is the face ply of the board, i.e., the surface of the board intended to be the upper visible surface of the board when installed, although not required. Use of only a straight line planning approach results in simply a non-realistic series of parallel ridges and valleys, running parallel to the edge of the board. Such straight line planing does not simulate the randomness found in boards worn normally over time, nor would it come close to simulating the hand scraped look. A hand scraped look that simulates time worn board appearance, for example, can have overlap from one scrape to the next as it goes down the board length. To provide such a scrape characteristic, a surface profiling configuration is provided in the present invention operable to have cutting tools go in and out of the cut and to have some lateral side-to-side movement of the boards in controlled, synchronized manners, so as to avoid a straight line ("parallel") look in the scrapes.

It has been found that by using more than one profile (cutter) head for creating the ridges and valleys in a surface of a flooring board that random-looking scraped surface appearances can be provided. By having multiple (e.g., two or more) cutter heads with one or more different profiles, cutting to one or more different depths and coming into the cut at one or more different frequencies, a random overlap look can be simulated. For example, a second cutter head contacting a board surface for scraping can have fewer ridges and valleys than a previous first cutter head which scraped the same board surface at a previous station on the profiling machine. This approach assists in breaking up any parallel tracks imparted into the board surface by the first cutter head. Although use of two different cutter heads is illustrated herein, additional different profiled cutter heads (e.g., one, two, three, four, five, or more) can be used on the same machine to impart more randomness in the overall appearance of the scraped board surface.

The present invention relates in part to a method for imparting a simulated rustic or distressed surface effect in a board. The method includes advancing boards on a table, wherein the table includes a board supporting surface and one or two or more slot openings in the board supporting surface through which different rotary cutter heads having different cutting profiles protrude to be contactable with lower surfaces of the boards advancing thereover;

engaging opposite lateral sides of the boards with first and second laterally movable fences concurrent with the advancing of the boards on the table;

laterally moving the fences relative to the cutter heads;

engaging lower surfaces of the board with liftable bed plates defining the slot openings in the table as the boards are advanced on the table; and controlling the liftable bed plates and movable fences with one or more programmable controllers to control the depth of cut and/or lateral cut position on the lower surface of boards, wherein different and at least partial, overlapping patterns of scrapes are formed in the lower surface of the boards by the different cutter heads.

The present invention further relates to an apparatus for imparting a simulated rustic or distressed surface effect in a board. The apparatus includes a table that includes a board supporting surface and a plurality of slot openings in the board supporting surface;

first and second laterally movable fences for engaging opposite lateral sides of boards on the table;

a plurality of rotary cutter heads having different cutting profiles and the cutter heads are positioned at different slot openings, wherein each cutter head is fixedly mounted to a rotatable drive spindle, and the cutter head protrudes into the slot opening to be contactable with a lower surface of boards advancing thereover;

liftable bed plates forming portions of the table that define the slot openings;

a fence moving device for laterally moving the fences relative to the cutter heads;

a programmable controller; and feed rollers for advancing the boards down the table, wherein the programmable controller operable for controlling the liftable bed plates and laterally moving fences such that different and at least partial, overlapping patterns of scrapes are formed in the lower surface of the boards by the different cutter heads.

A profiling apparatus can be configured to vertically lift and laterally move the boards being scraped, instead of lifting or moving the tooling. A cam action device can be used for vertically lifting boards being scraped at the cutter head to control the depth of cut or prevent cut. Bearings can be mounted in a steel bar or other rigid bar installed under the bed plates of the apparatus such that as the bar moves back and forth, bed plate pins riding on the bearings can raise and lower the bed plates. The pins can be guided by bushings in a bar mounted just under the bed plates. The steel bar housing the bearings has an internal thread cut into an end. A threaded rod is inserted into the bar threads. Then, by turning the threaded rod, the steel bar can move laterally back and forth. By controlling the lateral movement of the bar, and by having pins of a certain length positioned over the line of travel of the bearings in the bar, the pins ride up and down on the bearings. The pins are positioned under the bed plates so as to lift the plates a specific amount as the bearings work as cams and lift the pins. This provides a configuration for making the cutting tools come in and out of the cut on a board. The bed plate defines a slot. The slot is an opening or through-hole defined in a liftable bed plate through which a cutting tool (e.g., a cutter head) can protrude above the bed plate and come into contact with the boards. The bed plates can be modified to minimize the slot width in the surface. Minimizing the slot opening can reduce the risk of snipe on the leading or trailing end of the boards as they pass over the cutting tool.

A fence driving device is provided to make the board move laterally side to side. This can help to disguise any straight parallel lines of the cuts. To accomplish the lateral movement, inboard and outboard fences are provided. These two fences are connected to each other using steel bars or other rigid brackets that have sufficient standoff in the intervening portion to arch over the path of the boards in the machine while connected to fences that straddle the path of travel of boards on the profiling machine. Two connecting bars can be attached to the inboard fence and to two jack screw devices. The jack screws can be right angle driven by worm gears and the gears can be driven by shafts connected to a gear box.

A board edge bevel cutting device or means can be provided on the profiling apparatus for beveling opposite edges of the boards. The bevel cutting device can be used to impart different bevel cuts on the opposite sides of the board wherein laterally adjacent bed plate lifters are provided which are independently lifted relative to opposite board edges.

In order to make the movements as random as possible, a system using servos and controller(s) can be used. Servo motors are attached to all the movement devices for controlling respective vertical or lateral movement of boards during cutting at the cutter heads. In one example, where board edge beveling is included with surface profiling operations, servo motors can be attached to four movement devices. In this illustration, one servo can drive each of three bars of three cam action devices so that the back and forth movement of the bars can be precisely controlled and varied, and thus provide up and down movement of bed plates. This translates into precise up and down positioning of the bed plates for edge beveling and surface profiling. A fourth servo motor can be used to drive a gear box, which is connected to the shafts driving the jack screws. This mechanism drives the fences back and forth at a controllable, variable rate such that board surface can move or shift laterally across the cutter heads during profiling.

The mechanisms described above are effective at creating the desired random-looking scraped surface, even if there is still some degree of parallelism to the patterns produced on the boards. Some "parallelism" can occur due to the use of two profiled cutter heads. As indicated, more than two different cutter heads can be used to further diminish any parallelism. Each cutter head generates a different pattern and the overlapping of different patterns can assist in breaking up other patterns to mask parallelism.

On the control side of the present methods and apparatus, an automated controller and programming for the control system can be provided. A programmable controller, for example, can be used to implement a control program to drive the servo motors (axes). Each axis has three parameters to attain the proper movements of the moulder elements. These parameters are the "position" to which the element travels; the "speed" at which it travels to reach the "position" and the "dwell," or time it stays at a particular position before moving to the next position. These parameters can be manipulated independently to develop a "recipe" to produce a specific look. Via an HMI (touch screen), up to five values each for position, speed and dwell can be set. These values are essentially the number of encoder pulses generated to produce a specific number of revolutions of the servo motors.

Different operating modes can be used. For example, one mode can be using a random number generator to allow the random selection of a value for each parameter for each movement of an element. Another mode of the operation is referred to herein as "configuration" mode. When the configuration mode is activated, the three parameters are treated as a group. That is, a particular position has a specific speed and specific dwell assigned to it. So even though the position is chosen randomly, once it is, the speed and dwell are automatically chosen.

Referring to FIG. 1, an apparatus 1 is shown for mechanically forming a simulated rustic or distressed look in boards. The apparatus 1 has a table 12 that includes a board supporting surface 14 and a plurality of slot openings 16, 18, and 20 in the board supporting surface 14. The direction of movement of a board 6 on the table 12 is shown by the arrow. Boards can be fed end-to-end or individually through the apparatus. Rotary cutting tool 17 at initial slot opening 16 can be used to cut bevel edges on the board 6. Cutting tool 17 has a drive spindle 7 carrying two laterally spaced apart cutting tools 13 and 131 for beveling opposite lateral edges of a board. In FIG. 1, beveled edge cutting tool 131 is generally hidden from view behind cutting tool 13. Rotary cutter heads 19 and 21 having different cutting profiles 23 and 25 are arranged at slot openings 18 and 20, respectively. Rotary cutter heads 19 and 21 are used to impart a random-looking scraped pattern in the lower surface of the boards. The rotary cutter heads 19 and 21 are fixedly mounted on respective rotatable drive spindles 9 and 11. The cutter heads can be mounted to the spindles by a hydrolock mechanism or other suitable or conventional mounting design. The cutter profiles 23 and 25 protrude into the respective slot openings 18 and 20 to be contactable with a lower surface 60 of the boards 6 advancing thereover. Sets of motor driven feed rollers 2-5, for example, conventional toothed feed rollers, such as used in moulding, planing or milling machines, can be used for advancing the boards down the table in a controlled manner. Board 6 leaves the apparatus with beveled edges and a scrape-profiled lower surface 601 having a random-looking appearance that can simulate a time worn board.

Figure 2:
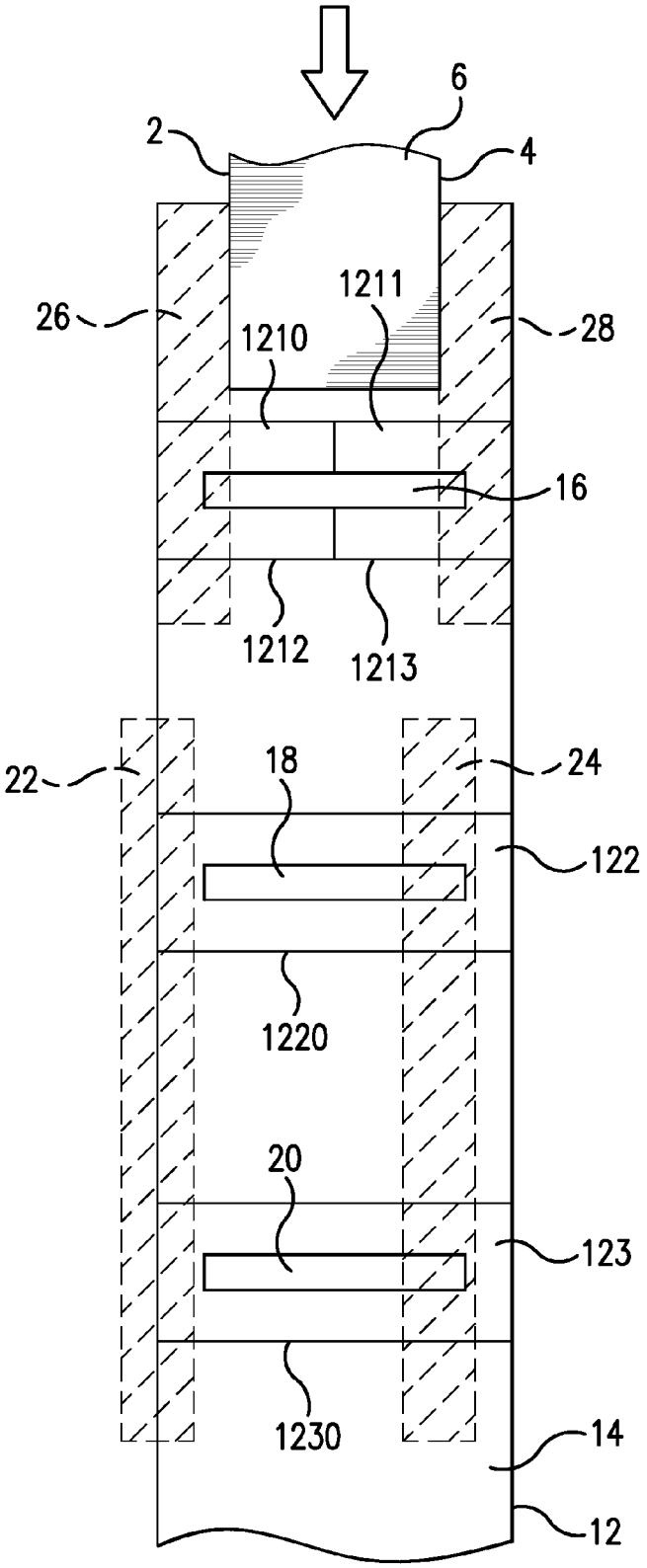
FIG. 2 shows a schematical plan view of the board scraping machine of FIG. 1.

As shown in FIG. 2, the apparatus 1 has first and second laterally movable fences 22 and 24 (shown by cross-hatching) for engaging opposite lateral sides 2 and 4 of boards 6 on the table 12. The fences 22 and 24 extend along the table surface 14 including where slot openings 18 and 20 are located. FIG. 2 shows the laterally movable fences 22 and 24 in one of the laterally shifted positions that the fences move to as the fences move back and forth laterally relative to the cutter heads 19 and 21 (not shown in FIG. 2) in slot openings 18 and 20 where the lower surfaces of boards are exposed to the cutter heads. Stationary opposite fences 26 and 28 (shown by cross-hatching) are used in association with the initial slot opening 16 to guide boards in fixed lateral positions over that slot opening for beveling board edges. Liftable bed plates 1210, 1211, 122, and 123 form portions of the table 12 that define one of the slot openings 16, 18, and 20, respectively. Bed plates 1210, 1211, 122, and 123 are each a separate and unitary piece. The slot openings can be contained in the bed plates. For example, a bed plate sized approximately 12 inches (board travel direction)×10.5 inches (width) can have a slot opening of size approximately 2.5 inches (board travel direction)×approximately 8 inches (width) cut into the bed plate, appropriately spaced from the perimeter of the bed plate to afford clearance for the cutter head to protrude therethrough. Other plate and opening dimensions can be used. The slot opening has a geometry which permits the cutter head to protrude through the plate without interference (e.g., rectangular, square, oval, etc.). Liftable bed plates 1210 and 1211 at rotary cutting tool 17 are laterally-adjacent unitary components having generally similar shapes that each define approximately one-half of slot opening 16. Bed plates 1210 and 1211 can be lifted independently of one another to independently lift the lateral edges of a board away or towards the associated cutter head. This allows different bevel cuts to be imparted on the opposite edges of the board. Bed plate sections 1210 and 1211 have respective integral downstream plate portions 1212 and 1213 thereof. Liftable bed plates 122 and 123 are each a single piece liftable plate. Bed plates 122 and 123 simultaneously lift (or lower) at both lateral edges of a board. Bed plate 122 has downstream integral plate portion 1220, and bed plate 123 has downstream integral plate portion 1230. As illustrated herein, the downstream bed plate portions 1212, 1213, 1220, and 1230 are where lift forces can be provided on the respective bed plates.

Figure 3:
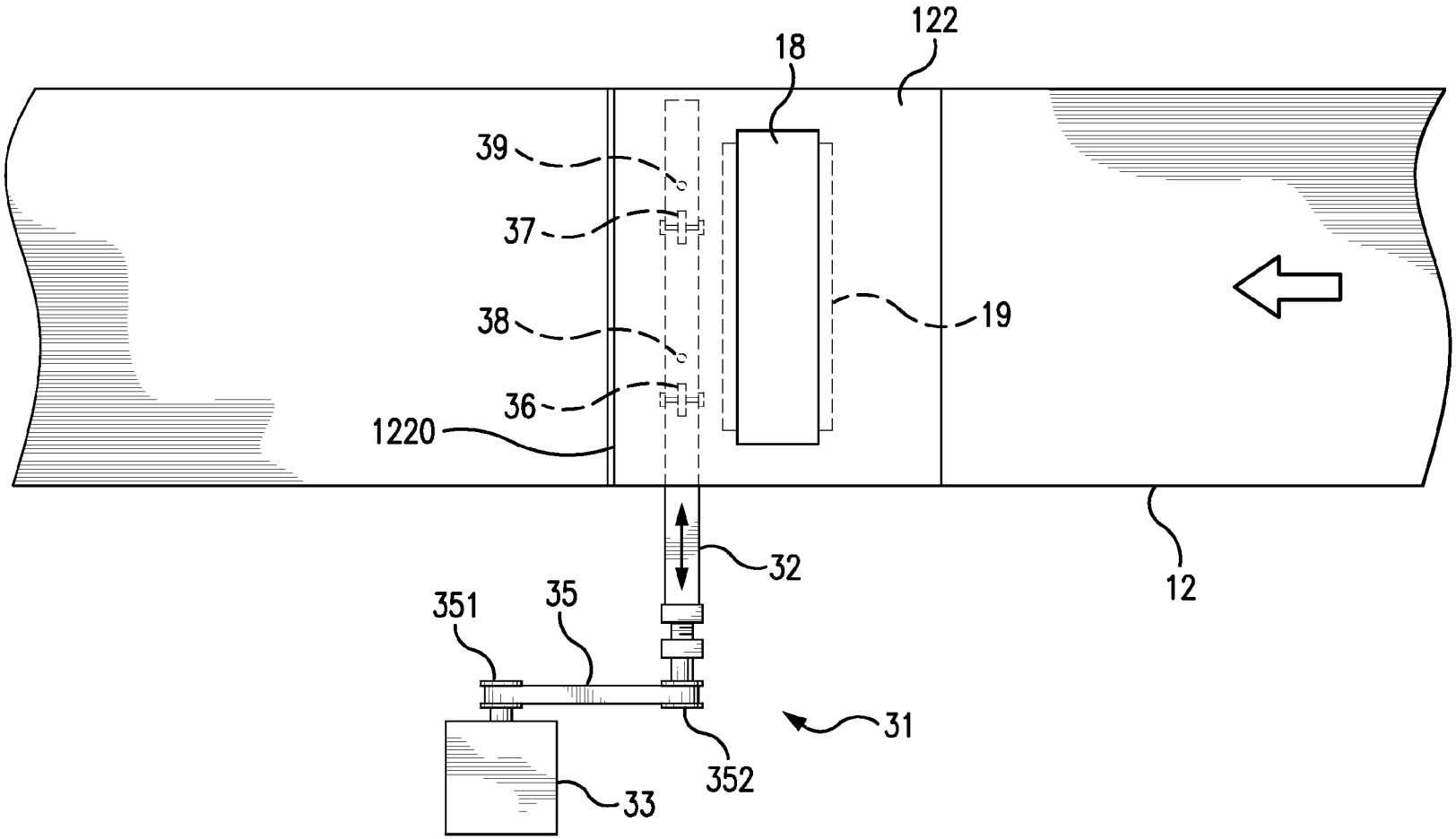
FIG. 3 shows a partial plan view of one example of the board scraping machine showing a bed plate lifting mechanism in accordance with the present invention.
Figure 4:
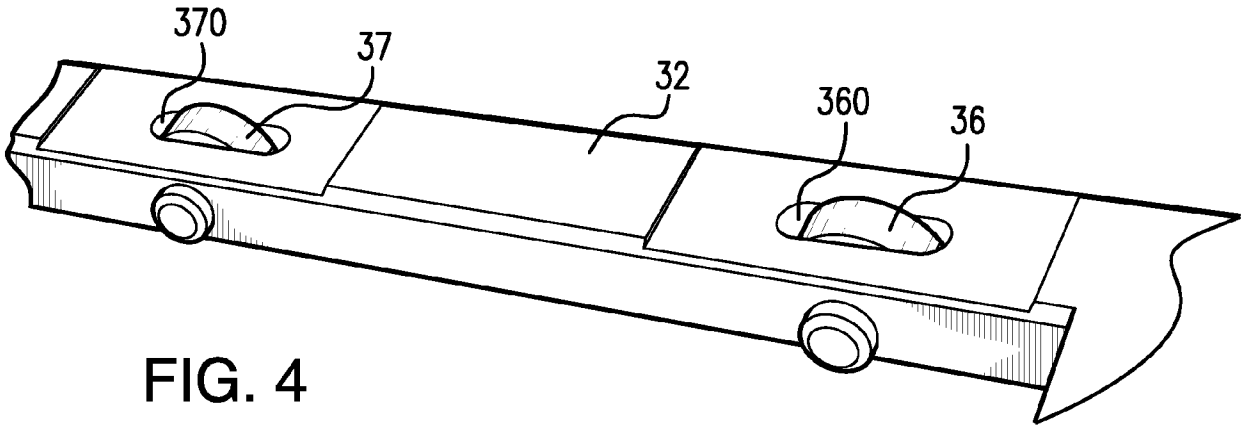
FIG. 4 shows an enlarged perspective photographic view of one example of a steel bar component with bearings of a cam action device of the apparatus of FIG. 1 in accordance with the present invention.
Figure 5:
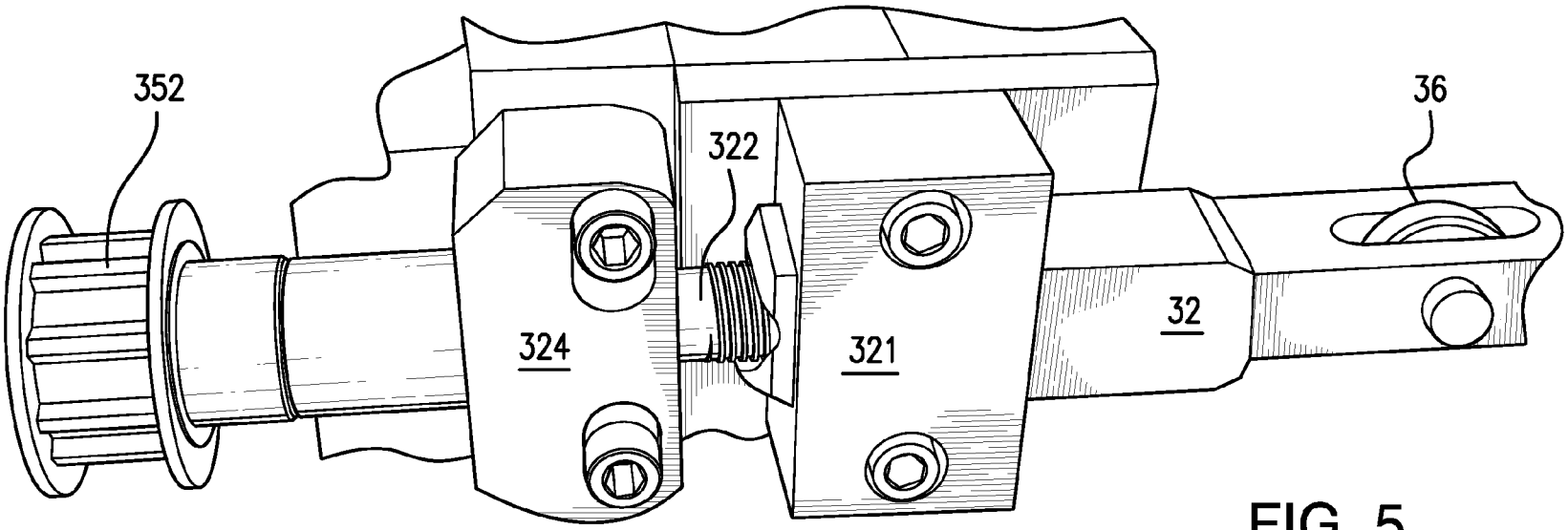
FIG. 5 shows an enlarged front photographic view of one example of a portion of the steel bar component of FIG. 4 shown in combination with inter-threaded end members in accordance with the present invention.
Figure 6:
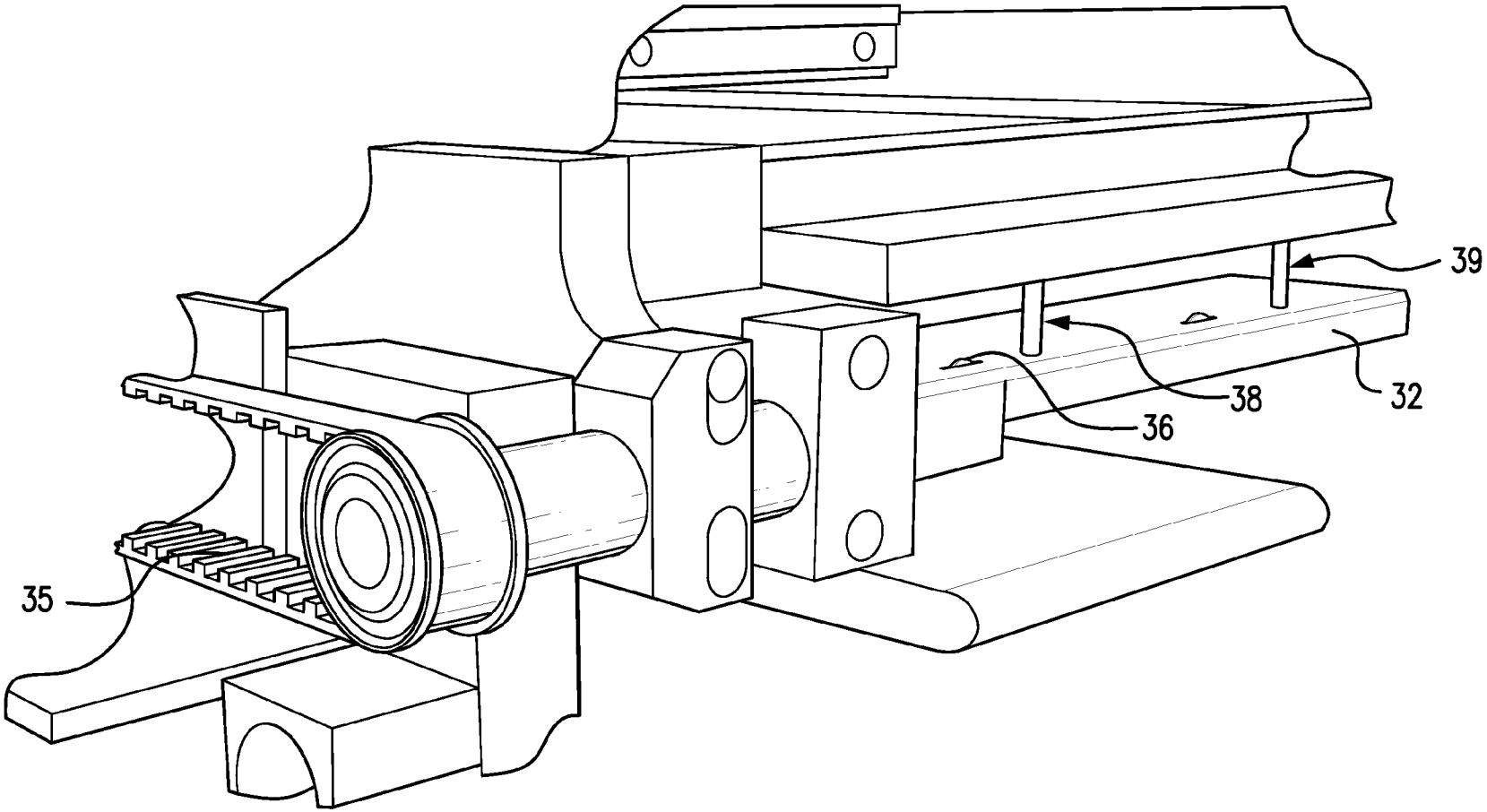
FIG. 6 shows a front perspective photographic view of one example of a portion of a cam driving mechanism in accordance with the present invention.

Referring to FIG. 3, a cam action device 31 used for lifting bed plate 122 relative to cutter head 19 is shown. Cutter head 19 is shown in its profile only to simplify the illustration. Only a top portion of the cutter head 19 protrudes through slot opening 18 to above the plane of plate 122 from below, and the remainder of the cutter head is below the plate. The cutter head size can exceed the slot size in the board travel direction to an extent without making interference. The width of the cutter head generally has a size that can fit within the slot opening width. A servo motor 33 drives the cam action device 31 via a servo drive belt 35. Servo drive belt 35 is driven alternately clockwise and counterclockwise around a timing/drive pulley 351 and second pulley 352. The servo can operate to change the drive belt direction of rotation, for example, by the number of encoder pulses. As also shown in FIG. 4, bearings 36 and 37 are mounted in cut-outs 360 and 370 in steel bar 32 at fixed and separate lateral locations along the length of steel bar 32. The steel bar 32 is installed under the bed plate 122, wherein the steel bar 32 can move laterally back and forth, as shown by the double arrow in FIG. 3, relative to the direction of advancement of boards on the table, also shown by an arrow. Referring to FIG. 5, the steel bar 32 has internal threading (not shown) cut into one end, shown as a support block 321, and a threaded rod 322, extending from another support block 324, is screwed into the bar threads in steel bar 32 by motion and force translated from the servo drive belt pulley 352. By turning the threaded rod 322, the steel bar 32 moves laterally back and forth. As shown in FIG. 6, pins 38 and 39 extend downward from the bottom of the bed plate as arranged in fixed lateral positions. The amount of downward extension of pins 38 and 39 and upward protrusion of bearings 36 and 37 is set such that a portion of the pins will contact the exposed surface of the bearings when their lateral locations coincide as steel bar 32 laterally reciprocates back and forth below the bed plate 122. The bed plate 122 has freedom of movement upward. For example, the bed plate can rest on a frame support from which it can be lifted. The bed plate can be, for example, heavy metal construction. The feed rollers also exert a downward force on the plates via boards on the table. An upward lifting force on the plate needs to be sufficient to overcome these forces which tend to keep the bed plate at rest or return it to the rest position once lifted. As steel bar 32 laterally translates back and forth the bearings 36 and 37 will intermittently go beneath the pins 38 and 39, contact them, and vertical push the pins upward as the pins ride up the moving bearing, and hence the bed plate upward, until bearings clear the pins and then pins 38 and 39, and hence the bed plate, are lowered by gravity, until the steel bar 32 returns in the reverse direction and temporarily pushes the pins, and hence the bed plate, upward again, and so on as long as the cam action device is operating. The plate lifting mechanism is arranged to lift the downstream portion 1220 of the bed plate 122 (shown in FIG. 2) relative to the associated slot opening in the plate. The bearings 36 and 37 and pins 38 and 39 are arranged below the liftable downstream portion 1220 of the bed plate 122. The cam action of the bed plate lifting mechanism can lift the downstream portion of the bed plate, for example, a relatively small distance (e.g., less than about 0.1 inch, or from about 0.001 to about 0.08 inch, or from about 0.01 inch to about 0.07 inch, or from about 0.02 inch to about 0.05 inch, or other distances above or below this amount) and provide sufficient movement away from the cutter head to effect the depth of cut made into the board surface. The depth of the cut that can be made by a cutter head (19 or 21) into a board surface that is scraped can be, for example, less than about 0.050 inch, or from about 0.001 inch to about 0.050 inch, or from about 0.005 inch to about 0.025 inch, or from about 0.01 inch to about 0.020 inch, or other depths.

Figure 7A:
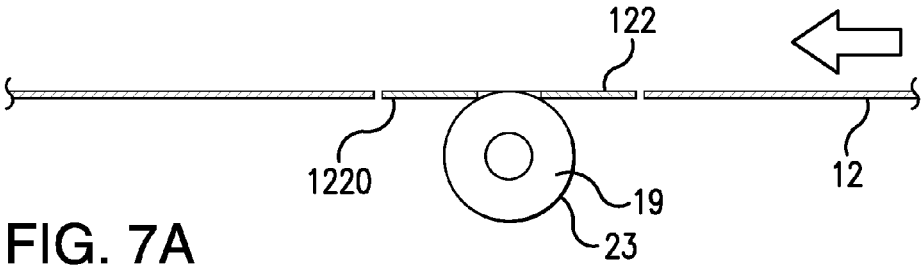
FIGS. 7A-7E shows a series of schematical side sectional views of the movements of one example of a bed plate lifting mechanism in accordance with the present invention.
Figure 7B:
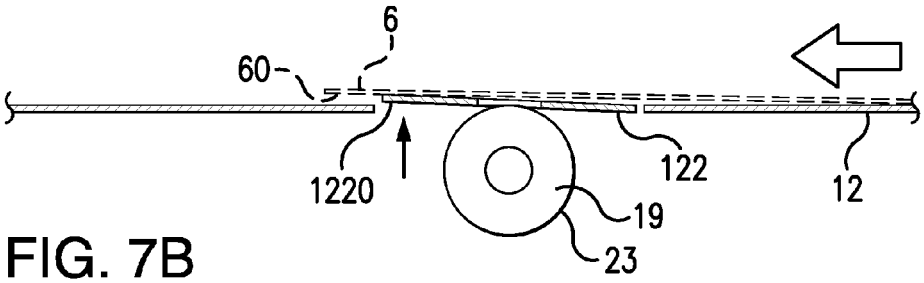
Figure 7C:
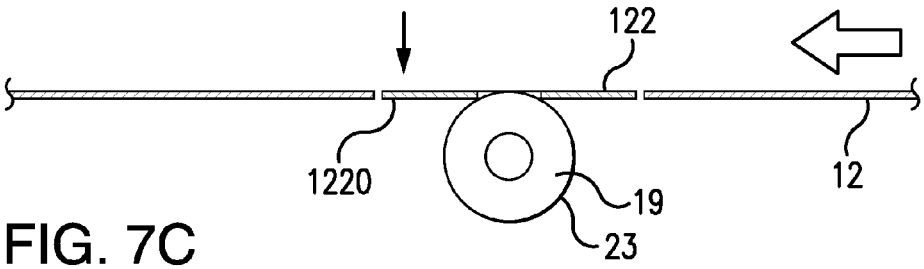
Figure 7D:
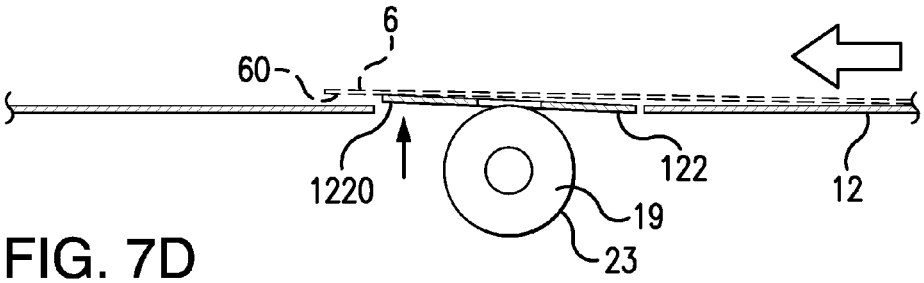
Figure 7E:
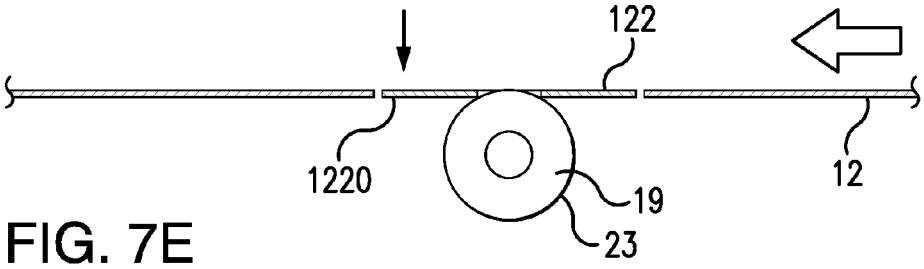
Figure 8E:
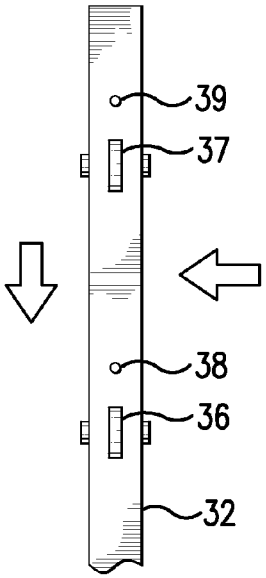
FIGS. 8A-8E shows a series of schematical plan views of the movements of one example of bed plate pins and steel bar bearings in correspondence to FIGS. 7A-7E in accordance with the present invention.
Figure 8D:
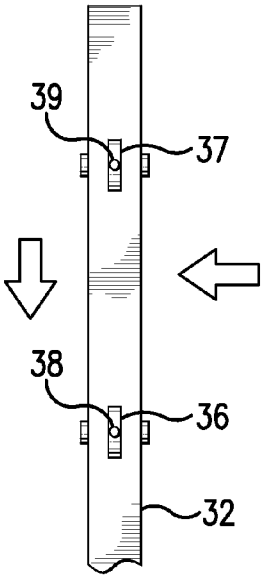
Figure 8C:
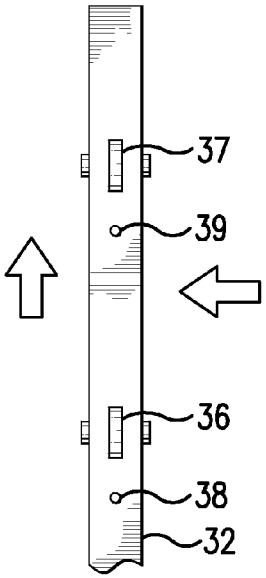
Figure 8B:
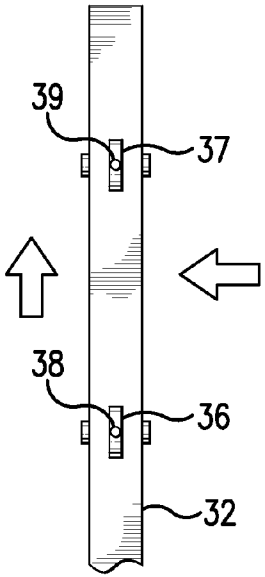
Figure 8A:
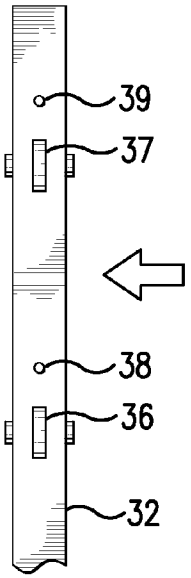
Figure 9A:
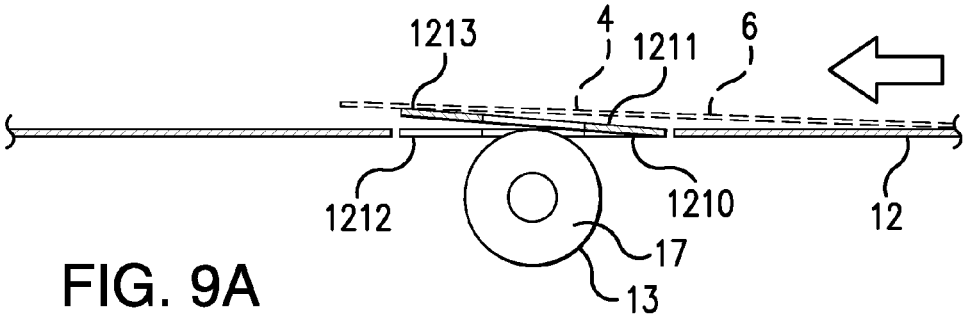
FIGS. 9A-9D shows a series of schematical side sectional views of the movements of one example of a two-part sectional bed plate lifting mechanism associated with a beveled edge cutter wheel of the apparatus in accordance with the present invention.
Figure 9B:
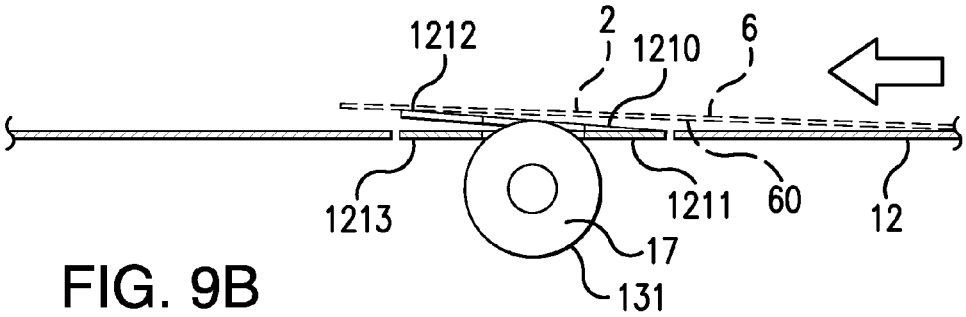
Figure 9C:
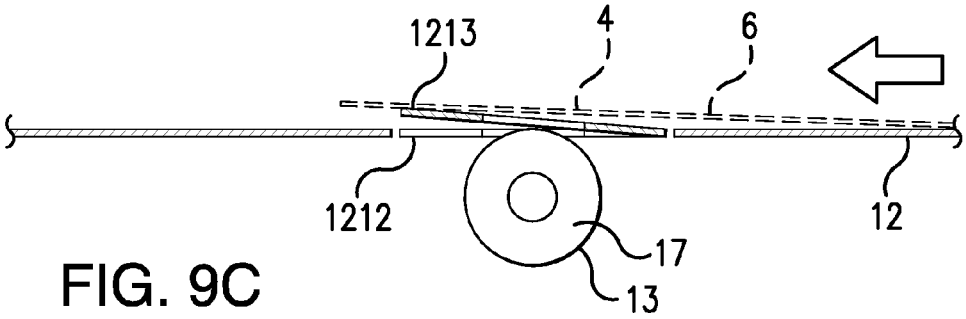
Figure 9D:
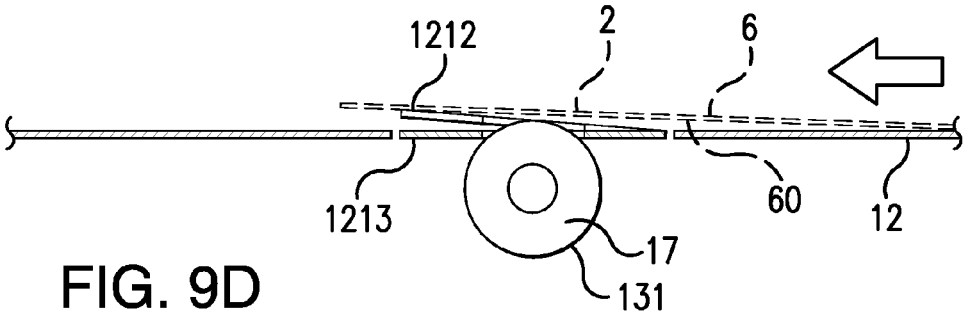

As shown in FIGS. 7A-7E and related FIGS. 8A-8E, the cam action device periodically vertically lifts bed plate 122 wherein the lower surface 60 of the board 6 (shown in hatched lines in FIGS. 7A-7E) is moved away from contact with the cutting profile 23 of cutter head 19. As the bed plate is lifted at the downstream portion 1220 of the plate 122, the plate is slanted slightly upward at that lifted portion above the horizontal plane of the table. The amount of slant and other dimensions may be shown in enlarged or modified forms relative to actual scale in the present figures to simplify the illustrations. FIGS. 8A-8E show a plan view of the pin and bearing positions corresponding to bed plate lift condition shown in FIGS. 7A-7E. The direction of board advancement on the table is shown by the large arrows and the lateral direction movement of the steel bar is shown by the smaller arrows. In FIG. 7A, as in FIG. 8A, the bearings 36 and 37 in steel bar 32 do not coincide with the locations of pins 38 and 39, and thus the downstream bed plate portion 1220 of bed plate 122 is in the rest (non-lifted) position. In FIG. 7B, as with FIG. 8B, the bearings and pins have coinciding locations and bed plate portion 1220 of bed plate 122 is lifted as the pins ride up the bearings. As shown in FIG. 7C, as with FIG. 8C, the bearings have cleared the pins for the time being, and bed plate portion 1220 of bed plate 122 is lowered back to the at-rest position. In FIG. 7D, as with FIG. 8D, the steel bar has returned after reversing its lateral direction and the pins are riding up the bearings again to temporarily lift bed plate portion 1220 of bed plate 122 until the bearing again clear the pins. In FIG. 7E (and FIG. 8E), the bearings and pins have returned to the similar non-coinciding positions as shown in FIG. 7A, and as shown in FIG. 8A, where the bed plate portion 1220 of bed plate 122 returns to the rest (non-lifted) position. The positions shown in FIGS. 8A-8E can be cyclical, where the bearing and pin positions shown in FIG. 8A can follow those shown in FIG. 8E, and so on, as long as steel bar 32 is being moved laterally back and forth relative to the bed plate pins. This movement of steel bar bearings relative to bed plate pins allows for changes in depths of cuts or no cuts to be imparted by the cutter head on the lower surface of the board. A similar servo driven cam action device and manner of operation is applicable to liftable bed plate portion 1230 of bed plate 123 associated with rotary cutter head 25.

As indicated, liftable bed plates 1210 and 1211 at rotary cutting tool 17 are used to impart beveled edges on the board. Plates 1210 and 1211 are separate adjacent right hand side and left hand side liftable bed plates, which have respective bed plate portions 1212 and 1213 on the downstream side of slot opening 16, such as shown in FIG. 2. At rotary cutting tool 17, a steel bar 32 is moved laterally back and forth as driven by a servo motor (not shown) and threaded rod similar to the drive arrangements for the steel bars used at liftable bed plate portions 1220 and 1230 of respective bed plates 122 and 123. As shown in FIGS. 9A-9D and related FIGS. 10A-10D, the pins 381 and 391 and bearings 361 and 371 used in the steel bar 32 at bed plates 1210 and 1211 can be positioned such that only one pairing of pin and bearing coincides under one respective liftable bed plate portion 1212 or 1213 thereof at a time as the steel bar 32 moves laterally back and forth. Other than this different positioning arrangement, the pins 381 and 391 and bearings 361 and 371 can be similar in construction as indicated for pins 38 and 39 and bearings 36 and 37, respectively, used with bed plates 122 and 123. One of the downstream portions 1212 or 1213 of bed plate sections 1210 and 1211 can be lifted while the other one is in a rest position (non-lifted), such that bevel cutting can occur differently and/or at different times on opposite edges 2 and 4 of the board being edge cut at one of cutting tools 13 or 131 of rotary cutting tool 17. The two adjoining and separate downstream portions 1212 and 1213 of bed plate sections 1210 and 1211, respectively, can be lifted independently of one another to independently lift opposite lateral edges 2 and 4 of a board 6 away or towards the associated cutting tools 13 or 131 at cutting tool 17. In this manner, for example, differential beveling can be provided on the boards, which can be desirable to complement the randomized-looking scrape pattern to be imparted to the lower surface of the board.

Figure 11:
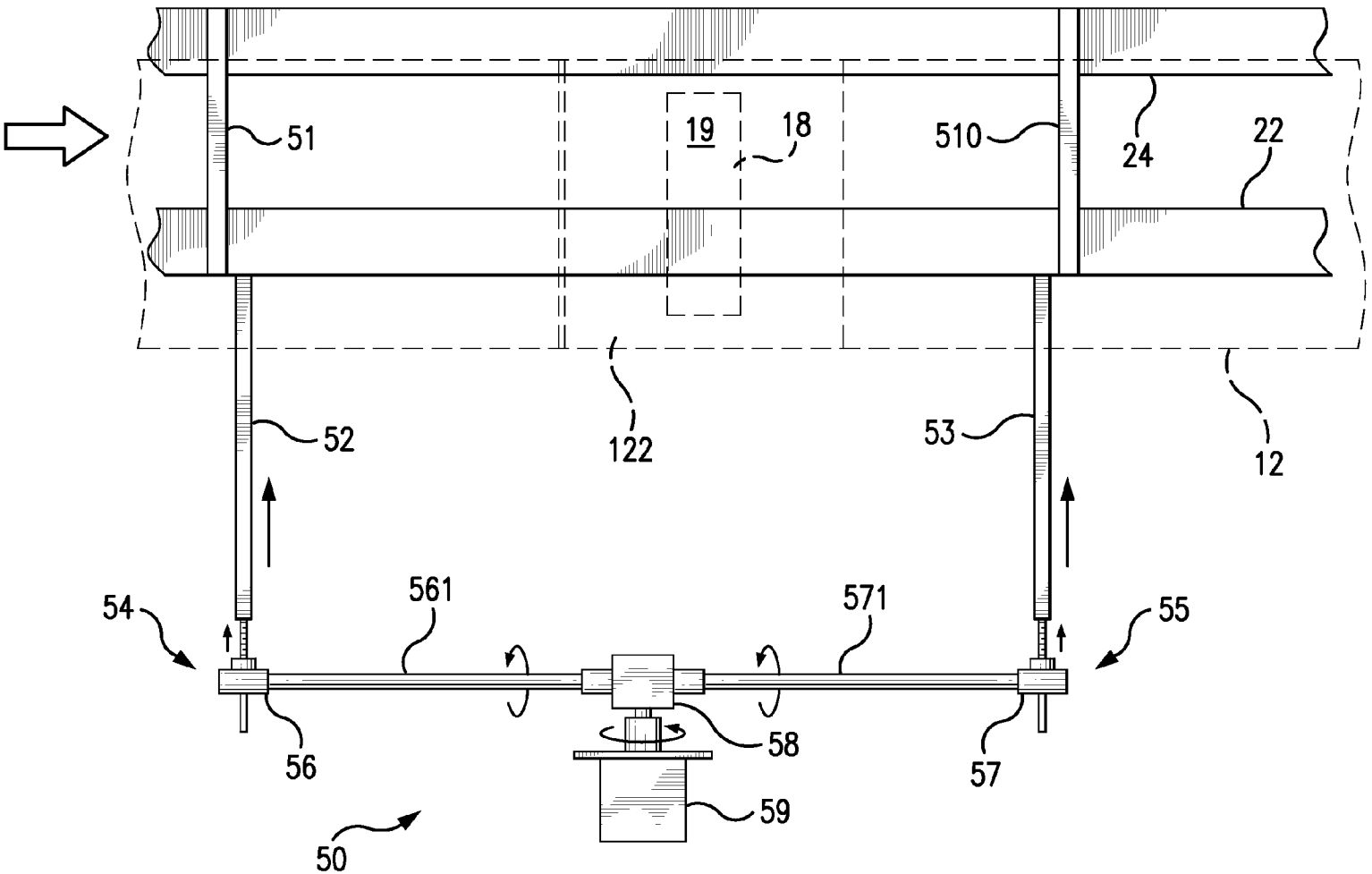
FIG. 11 shows a partial plan view of one example of the board scraping machine showing a fence moving device or means with fences moved to a first lateral position in accordance with the present invention.
Figure 12:
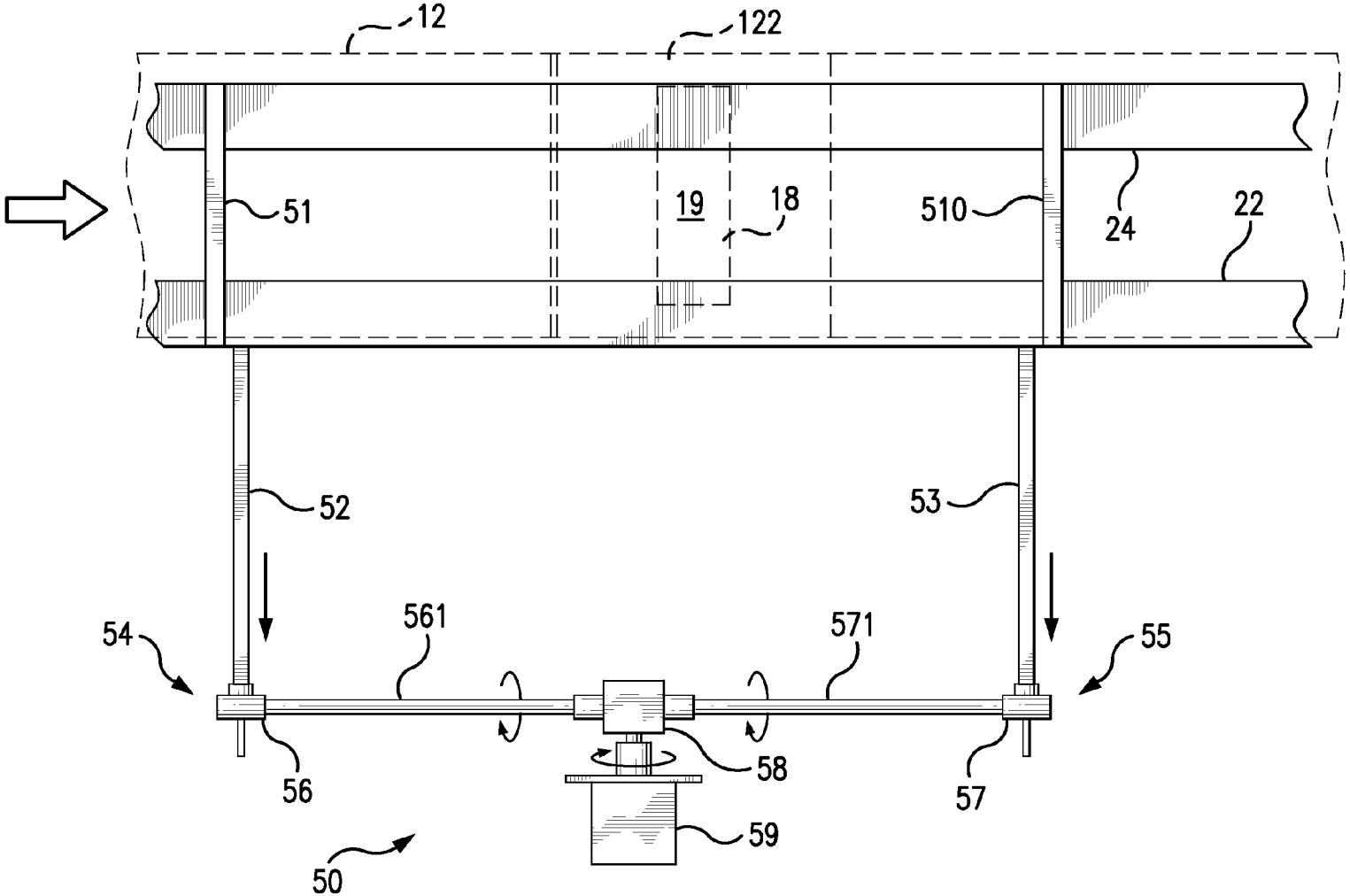
FIG. 12 shows a partial plan view of one example of the board scraping machine showing a fence moving device or means with fences moved to a second lateral position in accordance with the present invention.
Figure 13:
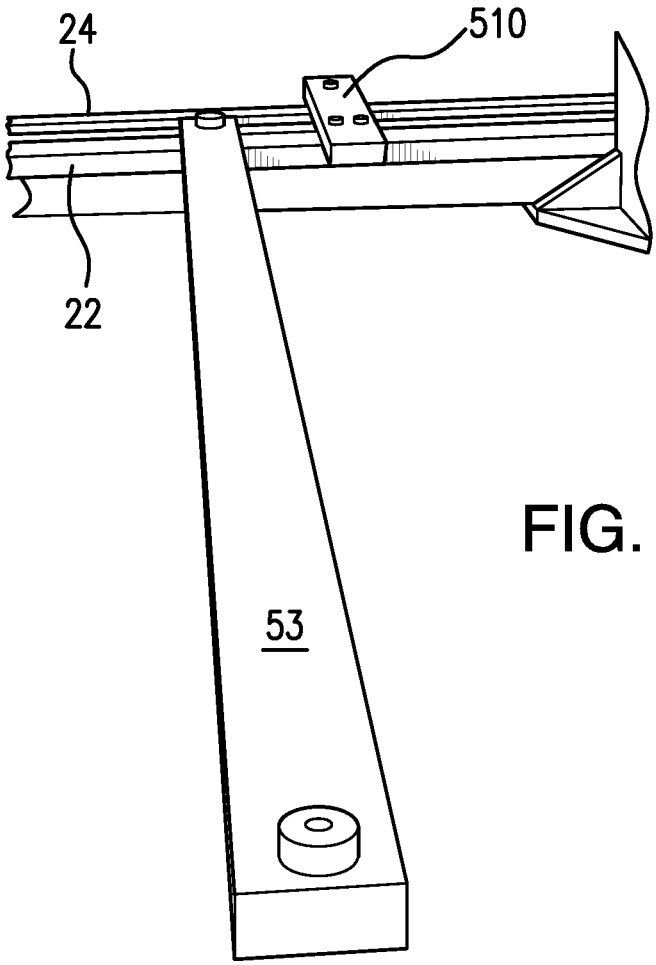
FIG. 13 shows a partial perspective photographic view of the fence moving device or means of FIGS. 11 and 12 including an inboard fence connecting bar component thereof, and a connecting bracket for connecting the fences, in accordance with the present invention.
Figure 14:
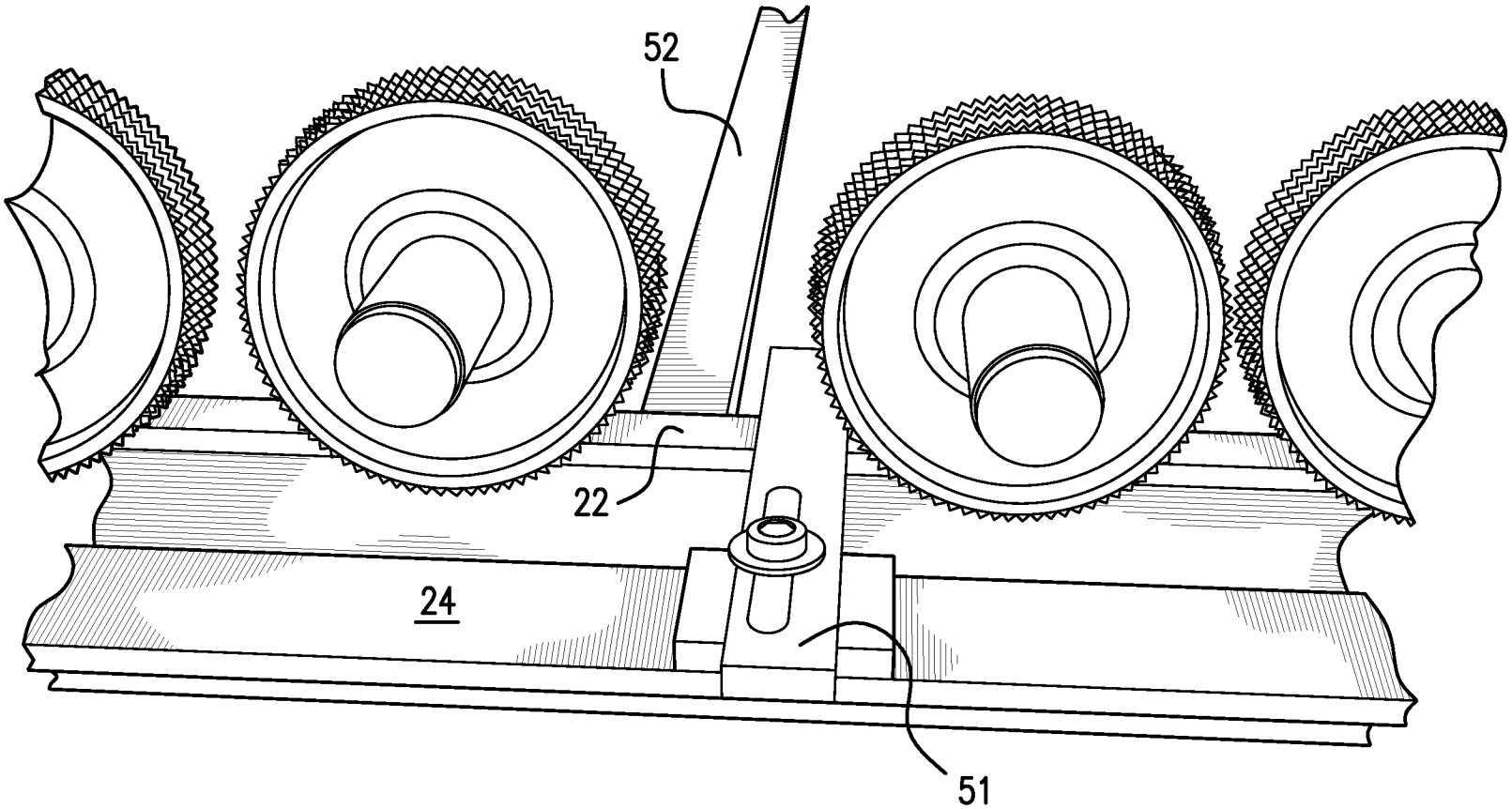
FIG. 14 shows a partial perspective photographic view of the fence moving device or means of FIGS. 11 and 12 including another one of the inboard fence connecting bar components thereof, and a connecting bracket for connecting the fences, in accordance with the present invention.
Figure 15:
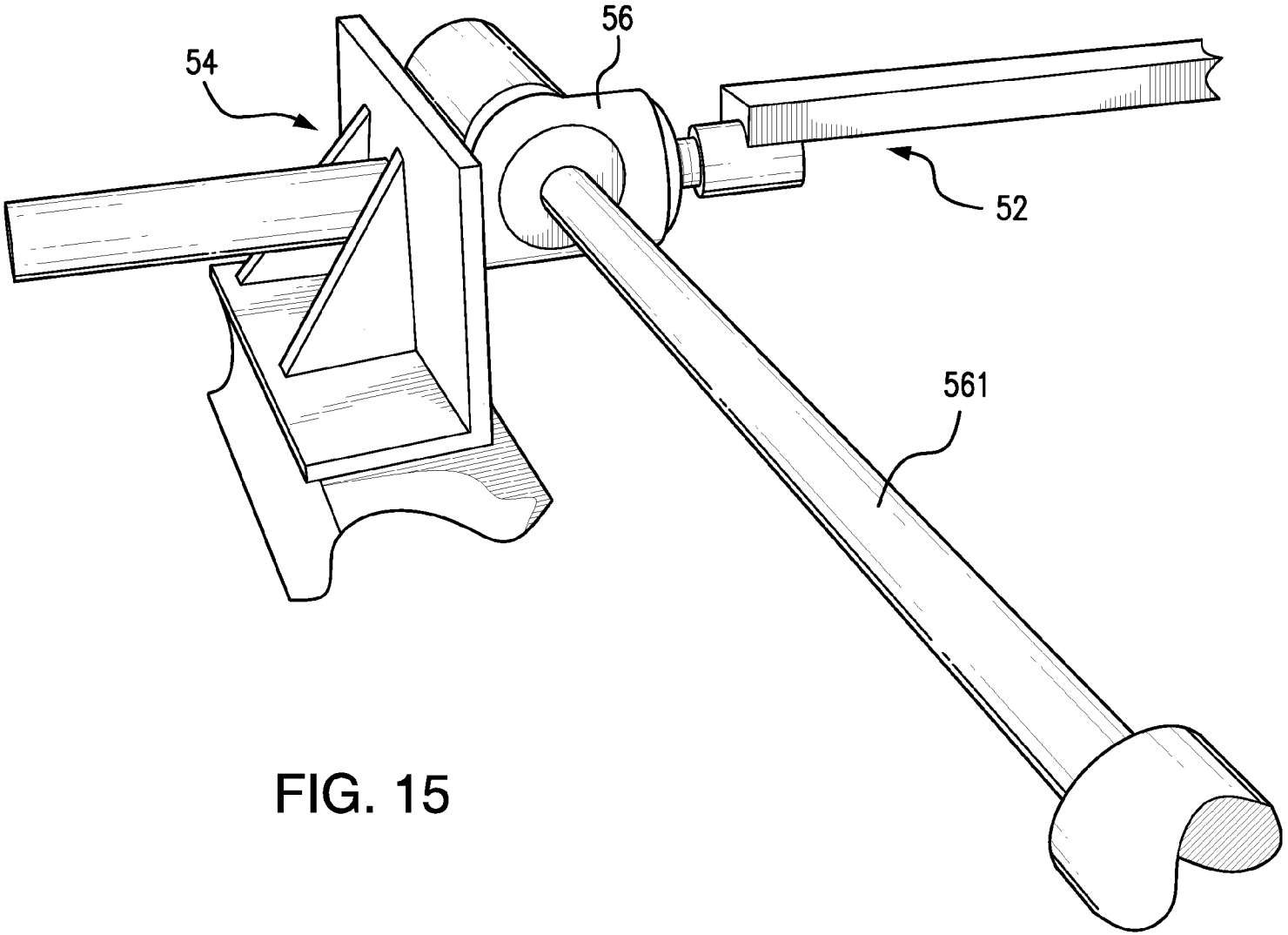
FIG. 15 shows a partial perspective photographic view of the fence moving device or means of FIGS. 11 and 12 including one of the jack screws and inboard fence connecting bar components thereof in accordance with the present invention.
Figure 16:
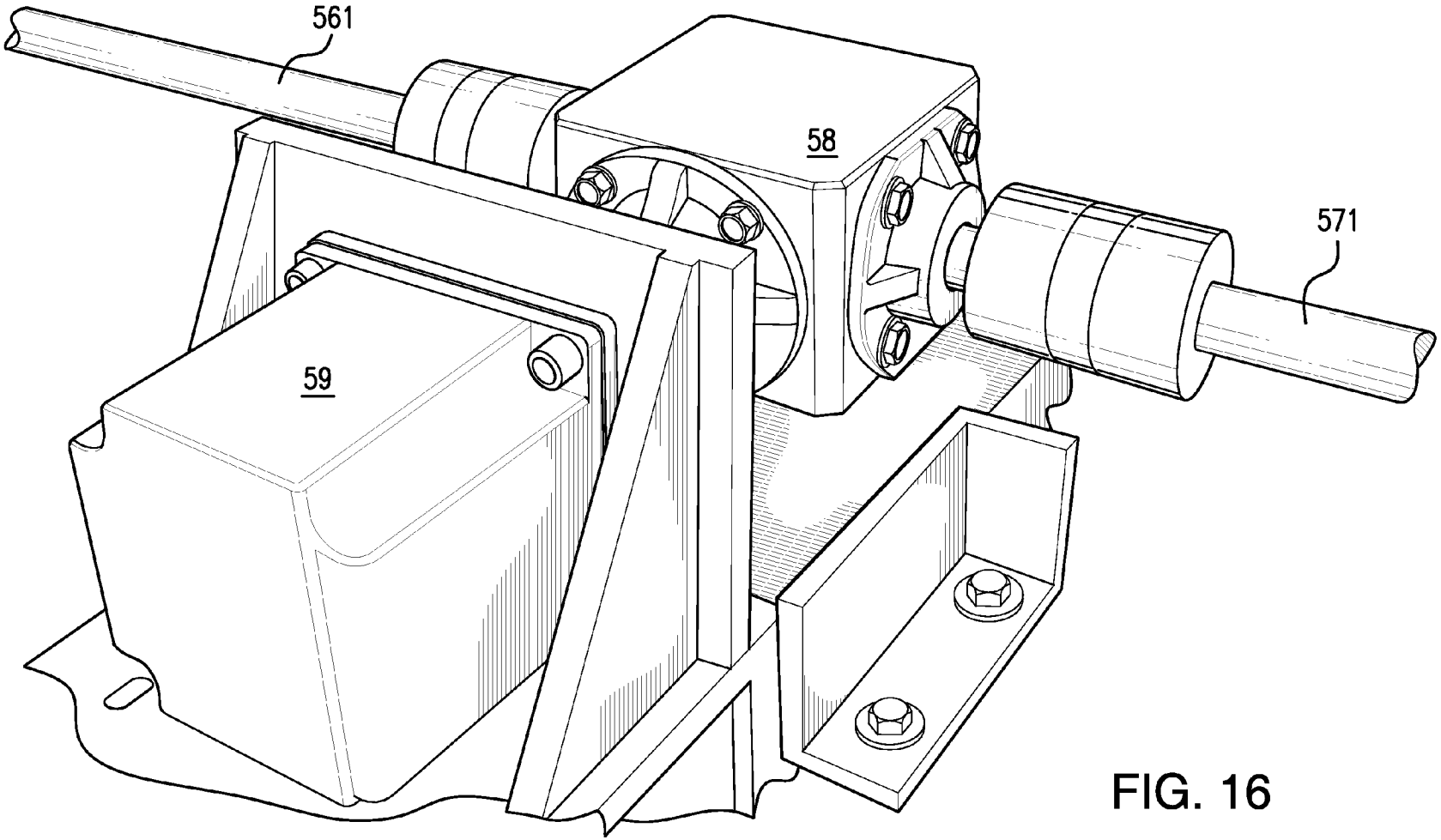
FIG. 16 shows a partial perspective photographic view of the fence moving device or means of FIGS. 11 and 12 including an enlarged view of a servo motor, gear box, and rotatable shaft components thereof in accordance with the present invention.
Figure 17:
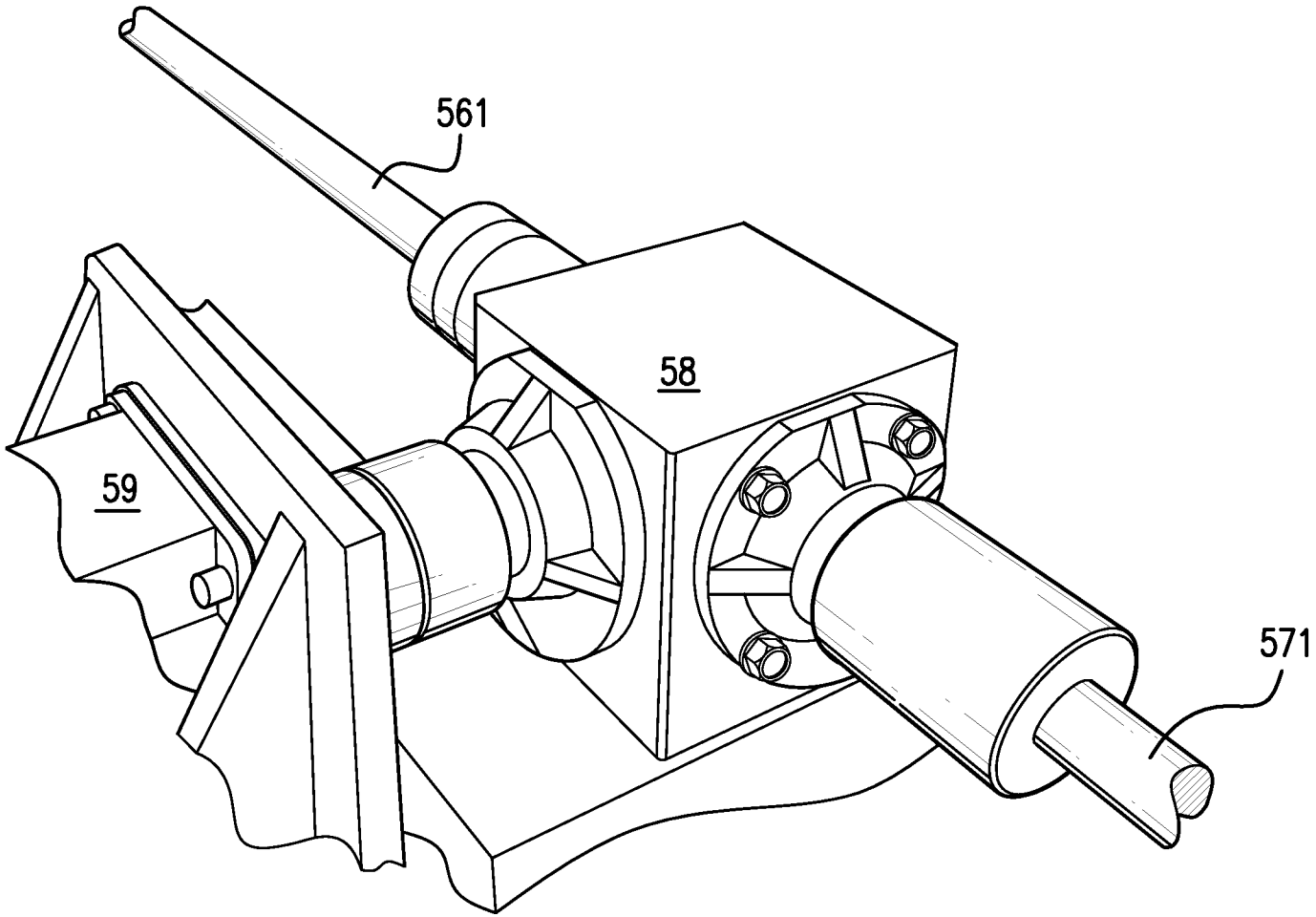
FIG. 17 shows a different partial perspective photographic view of the fence moving device or means of FIGS. 11 and 12 including an enlarged view of the servo motor, gear box, and rotatable shaft components thereof in accordance with the present invention.
Figure 18:
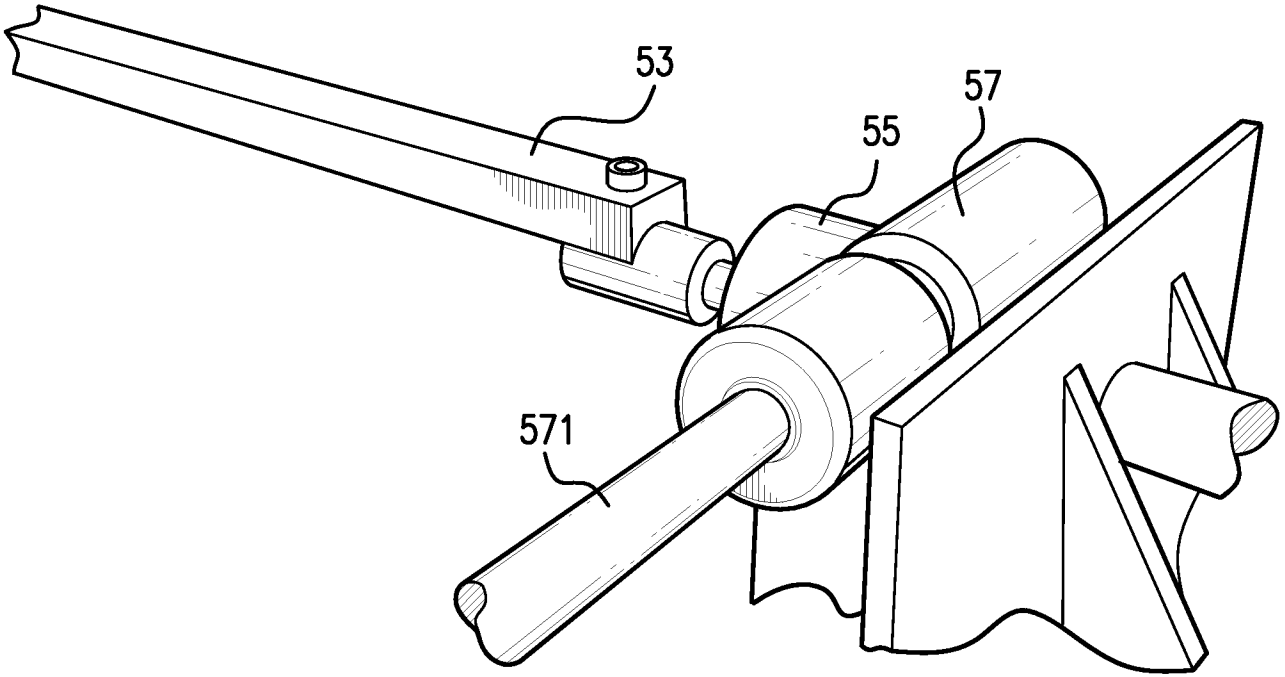
FIG. 18 shows a partial perspective photographic view of the fence moving device or means of FIGS. 11 and 12 including one of the jack screws and an inboard fence connecting bar component thereof in accordance with the present invention.
Figure 19:
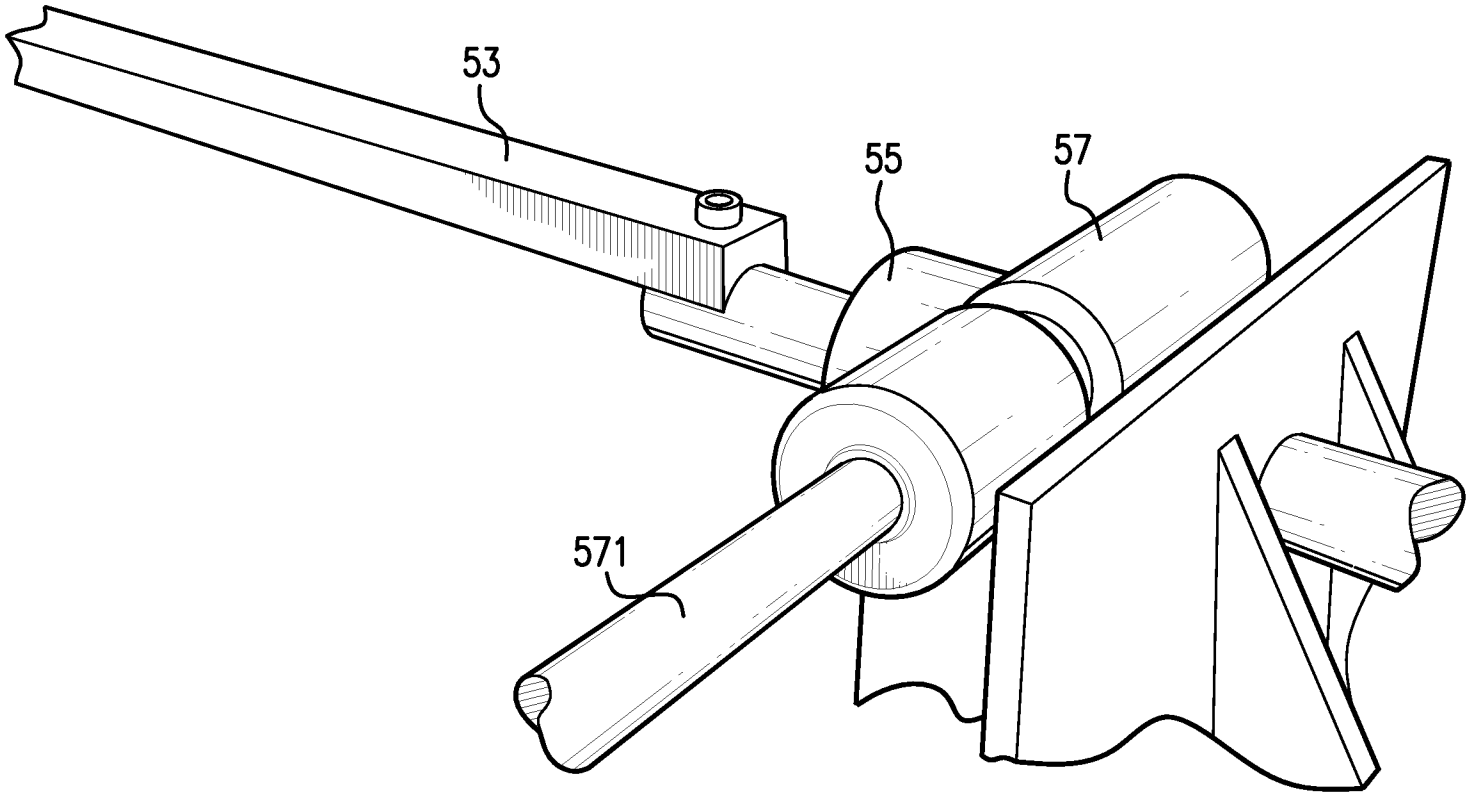
FIG. 19 shows a partial perspective photographic view of the fence moving device or means of FIG. 18 showing a jack screw and an inboard fence connecting bar component in retracted position in accordance with the present invention.
Figure 20A:
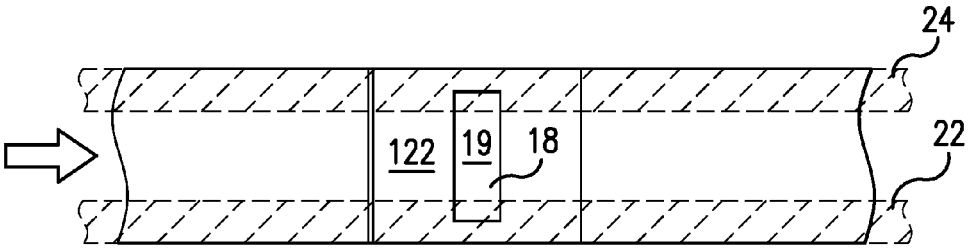
FIGS. 20A-20D shows one example of a series of schematical plan views of the movements of a fence moving device or means in accordance with the present invention.
Figure 20B:
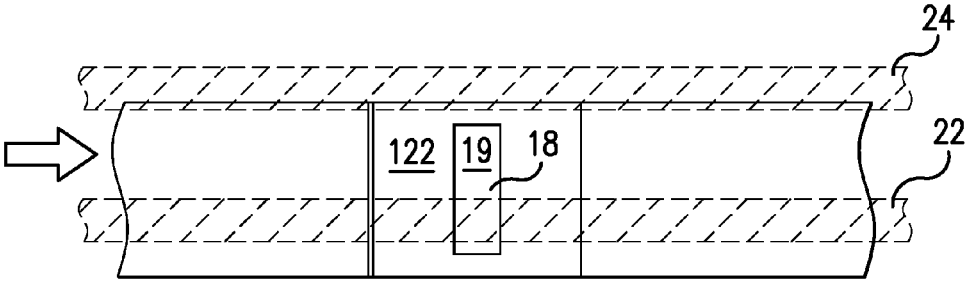
Figure 20C:
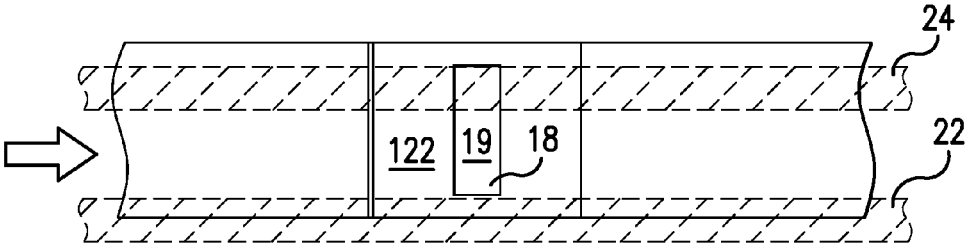
Figure 20D:
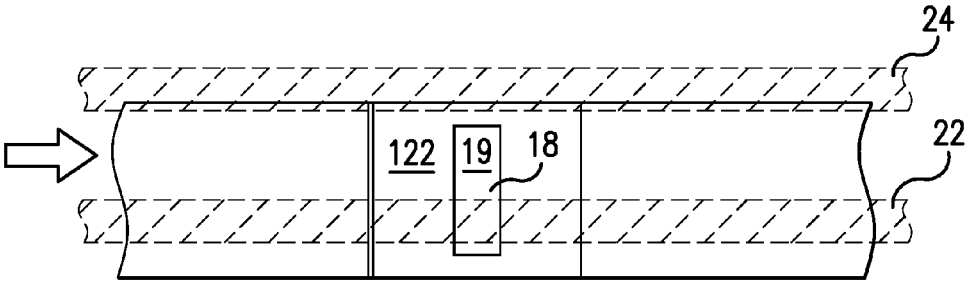

Referring to FIGS. 11 and 12, fence moving device (or means) 50 is shown for laterally moving fences 22 and 24 relative to cutter head 19 where exposed in slot opening 20 (and similarly cutter head 25 in slot opening 18, not shown). Fences 22 and 24 can be joined together for joint lateral movement. These two fences 22 and 24 can be connected to each other using a plurality of steel bars 51 and 510 or other rigid brackets. The fence connecting bars or brackets 51 and 510 have sufficient vertical standoff in the intervening portion between the fences 22 and 24 to arch over and clear the path of the boards advancing between the fences and along the table 12 in the direction shown by the large arrow. First and second connecting bars 52 and 53 are both attached to inboard fence 22, and to first and second jack screw devices 54 and 55, respectively. FIGS. 13 and 14 further show the connecting bars 52 and 53 attached to inboard fence 22 and the fence connecting brackets 51 and 510. First and second jack screws 54 and 55 (shown in FIG. 12) can be used to move the connecting bars 52 and 53, and hence the fences 22 and 24, laterally back and forth relative to cutter head 19 and cutter head 21 (shown in FIG. 12). The jack screws 54 and 55 can be right angle-driven by first and second worm gears 56 and 57 (shown in FIG. 12), respectively. The worm gears 56 and 57 are driven by shafts 561 and 571. FIG. 15 shows an additional illustrative view of an arrangement of one of the jack screws, right angle drive worm gears, inboard fence connecting bar components, and rotatable drive shaft. Referring to FIGS. 15-17, drive shafts 561 and 571 are connected to a common gear box 58, which is driven by a servo motor 59. FIGS. 16 and 17 show additional illustrative views of the drive shafts, gear box, and servo motor arrangement. The servo motor 59 drives the gear box 58 connected to the shafts 561 and 571, in turn, driving the jack screws 54 and 56, whereby the fences 22 and 24 can be driven laterally back and forth at a controllable, variable rate. Approximately 1.5 kW servo motors may be used for any of the servo motors duties indicated herein. In lieu of servo motors, other conventional motors can be used or devices to drive the movement described herein. The scale of the method, and other factors, can effect the motor power requirements. Referring to FIGS. 18 and 19, the extension and retraction, respectively, of one of the connecting bars 53 by action of one of the jack screws 55 is shown.

As shown in FIGS. 20A-20D, the fencing driving device or set-up periodically laterally moves fences 22 and 24 (shown is cross-hatched lines) relative to cutter head 19 where exposed in slot opening 20 (and similarly cutter head 25 in slot opening 18, not shown). This side-to-side motion imparted to the board workpieces by the fences contributes to the capability of the machine to impart different at least partial overlapping patterns of scrapes in the lower surface of the boards by the different cutter heads, assisting in imparting a random look.

Figure 21A:
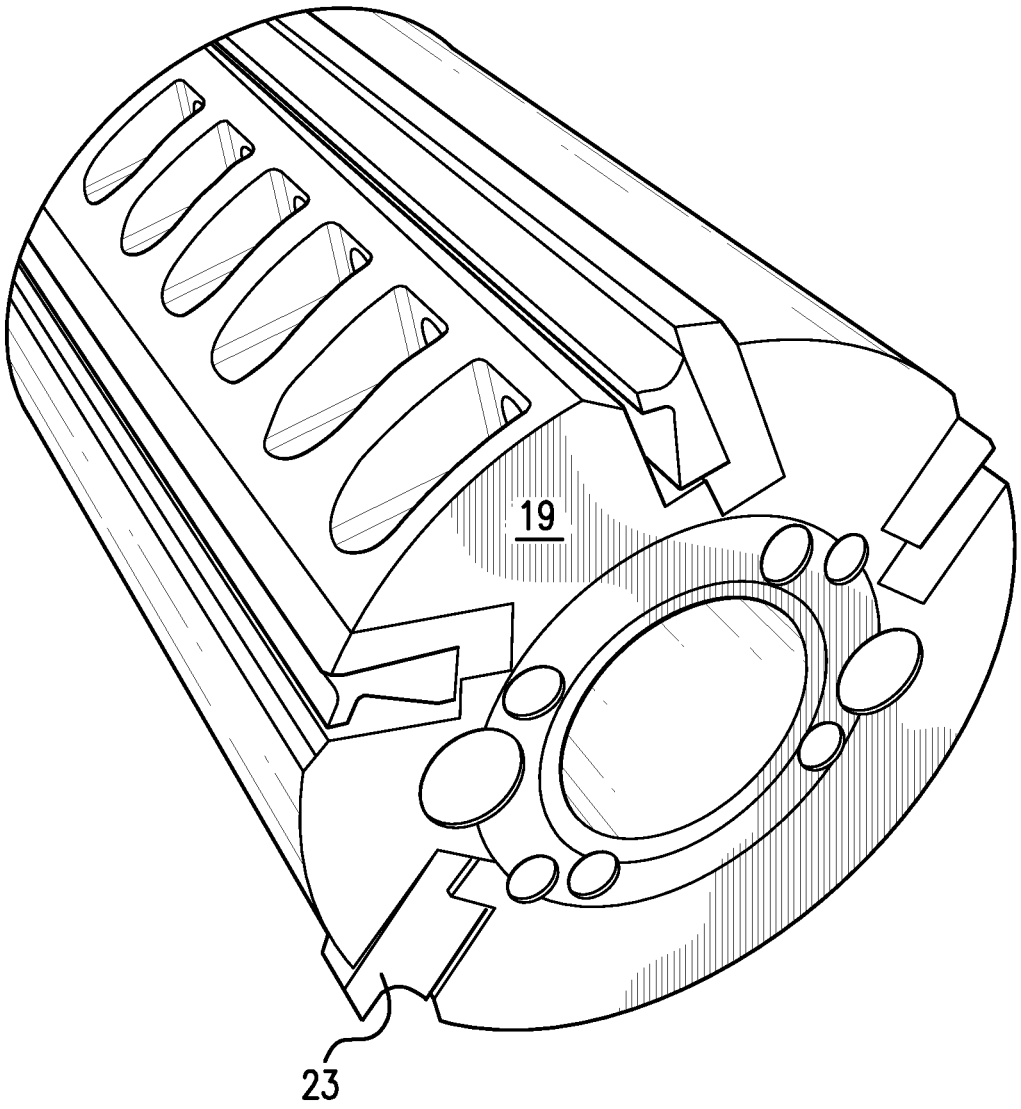
FIG. 21A shows a side perspective photographic view of one example of a portion of a rotary cutter head that can be used to scrape a board surface in accordance with the present invention.
Figure 21B:
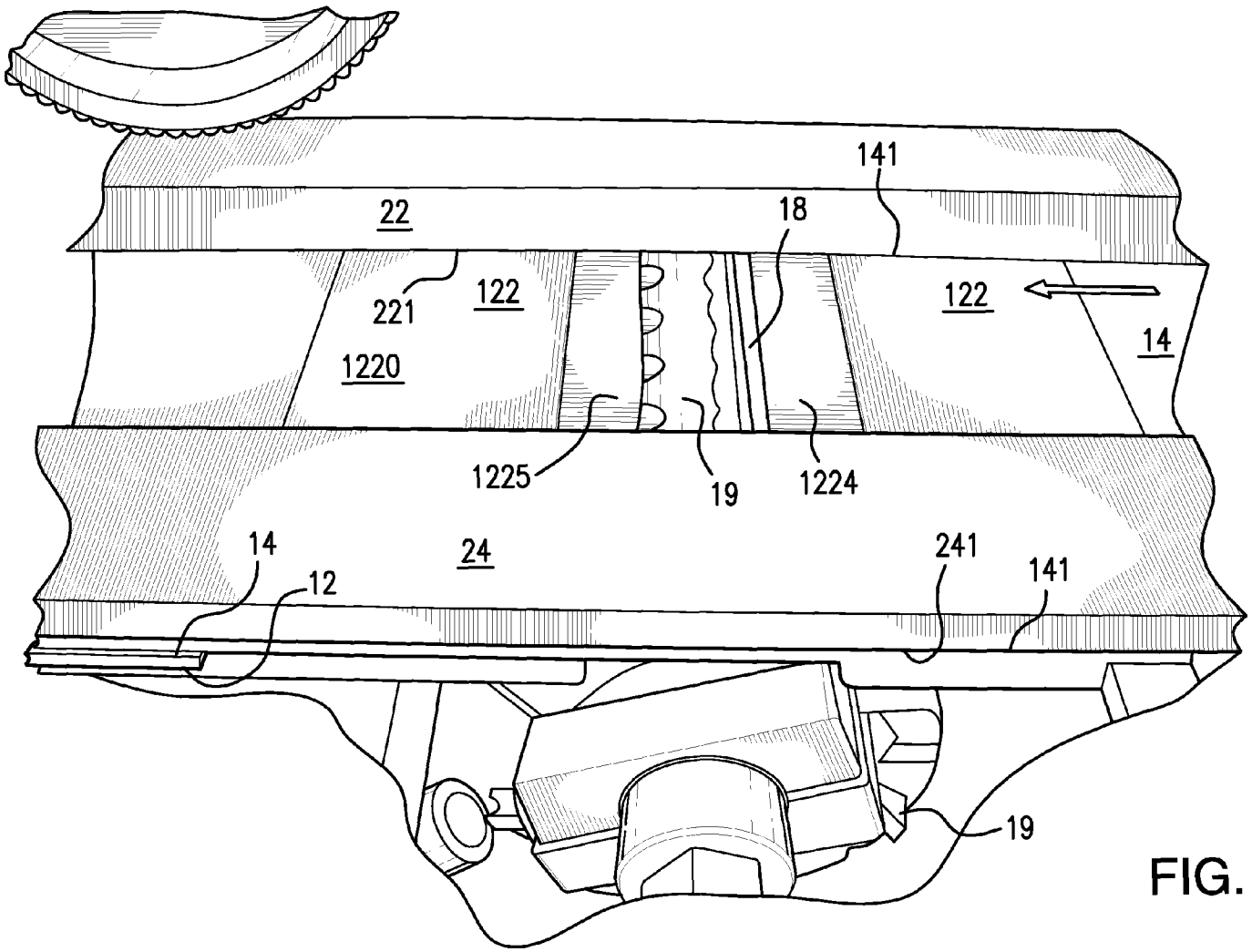
FIG. 21B shows a side perspective photographic view of one example of a portion of a rotary cutter head as protruding through a slot opening, which can be used to scrape a board surface in accordance with the present invention.
Figure 21C:
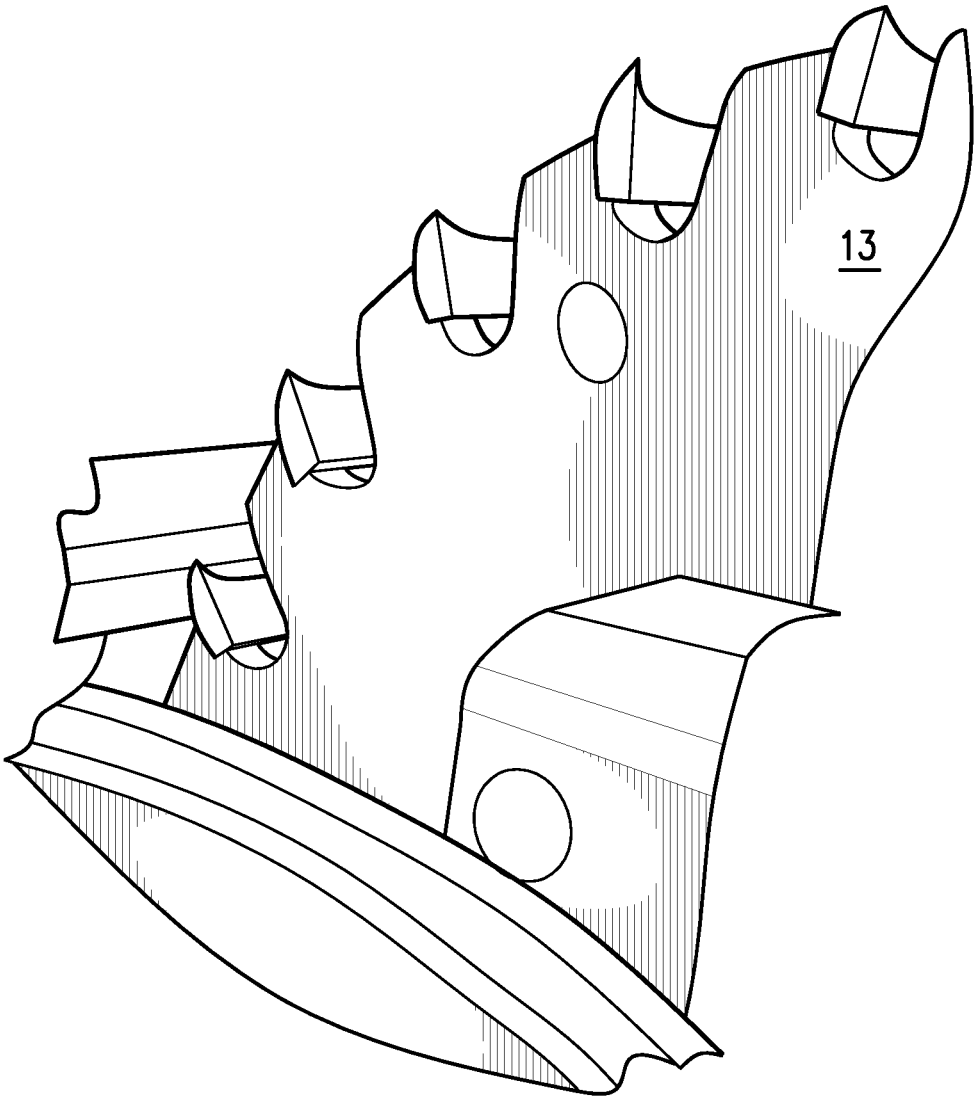
FIG. 21C shows a side perspective photographic view of one example of a portion of a rotary cutting tool that can be used to cut a beveled edge on a board in accordance with the present invention.

FIG. 21A shows a side perspective photographic view of a portion of a rotary cutter head 19 having cutting profile 23 that can be used to scrape a board surface. FIG. 21B shows a side perspective photographic view of a portion of a rotary cutter head 19 protruding through a slot opening 18 defined in bed plate 122 having downstream liftable plate portion 1220. The travel direction of boards on the table surface 14 is indicated by the arrow. The bed plate can include chromed portions or strips 1224 and 1225 immediately adjacent the slot opening 18. The cutter head can be used to scrape a board surface in the shown configuration in accordance with various embodiments of the present invention. Fences 22 and 24 have bottom surfaces 221 and 241, respectively, which can have clearance 141, for example, with respect to board supporting surface 14 of table 12, rotary cutter head 19 where protruding through opening 18, and liftable plate portion 1120 including when lifted. FIG. 21C is a side perspective photographic view of a portion of a rotary beveled edge cutting tool 13 that can be used, for example, to cut a beveled edge on a board. In this illustration, the cutter wheel has a series of peaks and valleys. The cutter head also has carbide tipped knives. Other cutter head types and configurations in the profiling machine industry also can be adapted for use in the present invention. U.S. Pat. No. 4,429,726, for example, shows cutter heads and related components which can be adapted for use as cutter heads to scrape a board surface or bevel edge cut on boards processed according to the present invention, which teachings are incorporated in their entireties by reference.

Figure 22:
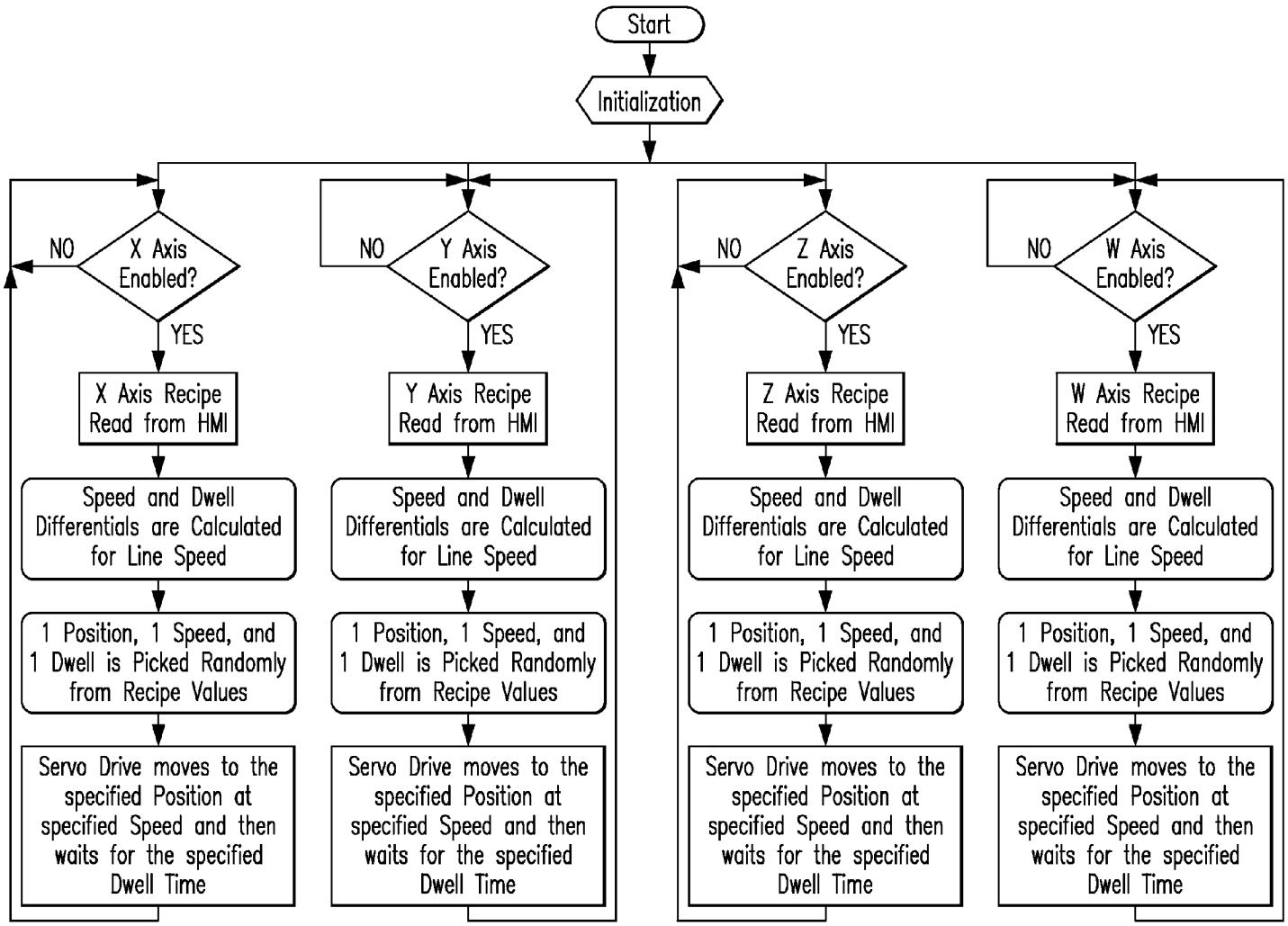
FIG. 22 shows a flow diagram of one example for programming the X, Y, Z, and W axes of the scraping/profiling of a board surface in a 4-axis programmable controller to impart a random-looking appearance in accordance with the present invention.

FIG. 22 shows one example of a flow diagram for programming the X, Y, Z, and W parameters of the scraping/profiling of a board surface in a 4-axis programmable controller to impart a random-looking appearance. In FIG. 22, for example, the x-axis can relate to a bevel edge cutting operation on the indicated apparatus (e.g., cutting roll 17), and the Y-axis and Z-axis can relate to first and second bottom profiling operations (e.g., cutter heads 19 and 21), and the W-axis can relate to the fence moving device (e.g., fence moving device 50). The 4-axis programmable controller can have a user interface for user input and program loading and activation, and a display(s) for operational monitoring. A commercial programmable controller that can be adapted to the present methods is, for example, a Yaskawa 4-axis controller.

Figure 23:
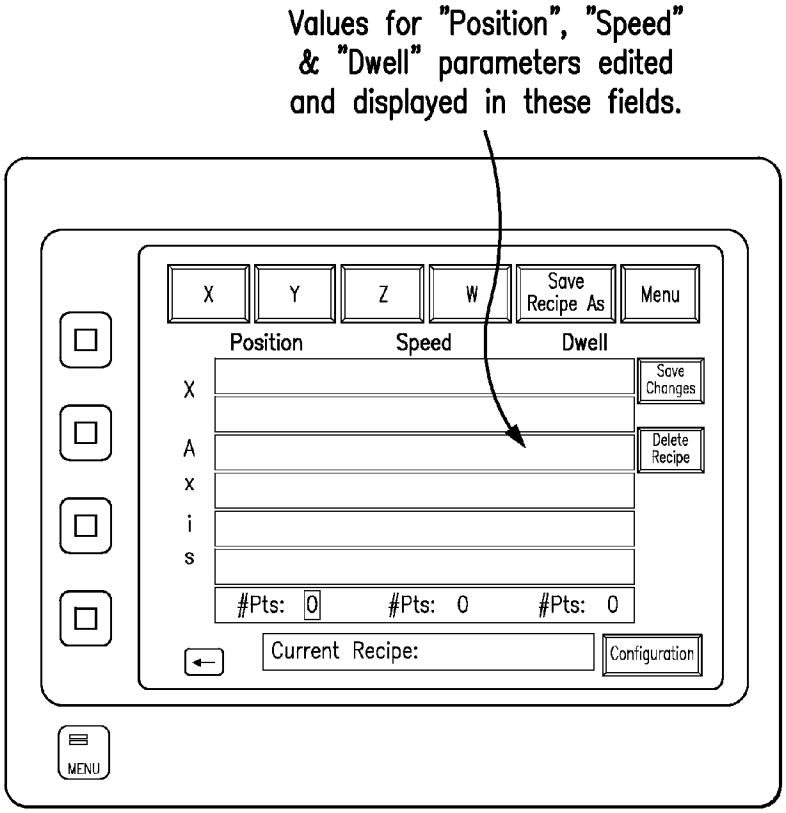
FIG. 23 shows one example of a touch screen display interface for a user to select position, speed, and dwell parameters of the axes of movement under programmed control in accordance with the present invention.

As indicated, a programmable controller, for example, can be used to implement a control program to drive the servo motors (axes) or other movement controlling devices. Each axis has three parameters to attain the proper movements of the moulder elements. As shown in FIG. 23, for example, they are the "position" to which the element travels; the "speed" at which it travels to reach the "position" and the "dwell," or time it stays at a particular position before moving to the next position. These parameters can be manipulated independently to develop a "recipe" to produce a specific look. Via an HMI (touch screen), up to five values each for position, speed and dwell can be set. These values are essentially the number of encoder pulses generated to produce a specific number of revolutions of the servo motors.

Figure 24:
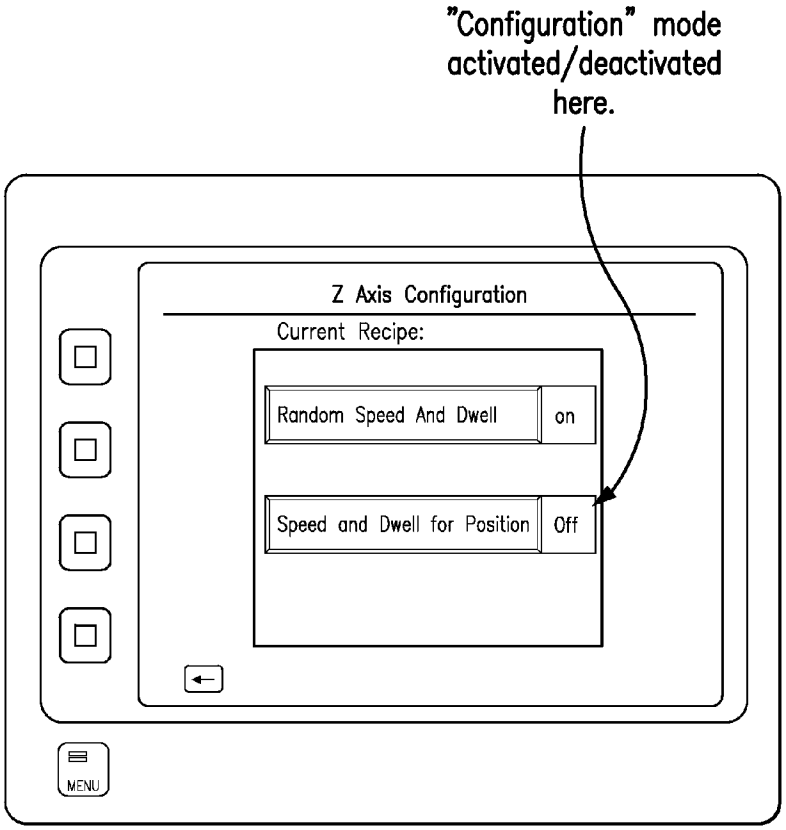
FIG. 24 shows one example of a touch screen display interface for a user to select a configuration mode of operation of programmed control in accordance with the present invention.

As indicated, different operating modes can be used. For example, there are at least two different operating modes that can be applied. One mode can be using a random number generator to allow the random selection of a value for each parameter for each movement of an element. In this mode, for example, any one of the position values is chosen without regard to sequence. Then, any one of the speed values is similarly chosen. And, finally, in a similar way, any one of the dwell values is chosen. Once the three values have been randomly selected, the movement is implemented. All of this selection process can occur at very high processing speed. Once the movement has been completed, the process is repeated for the next position. Referring to FIG. 24, for example, another mode of the operation is referred to herein as "configuration" mode. When the configuration mode is activated, the indicated three parameters are treated as a group. That is, a particular position has a specific speed and specific dwell assigned to it. So even though the position is chosen randomly, once it is, the speed and dwell are automatically chosen. The purpose of this mode is to allow a particular position to be achieved at a predetermined speed and to keep the element at that position for a predetermined dwell time. It affords the ability to keep a specific tool in (or out) of the cut for the defined length of time and only periodically allow it to enter (or leave) the cut.

Other variations on the described profiling machine and modes of operation can be used. For example, programming changes that allow proportional ramping up and down of the various movement devices as the throughput speed of the moulder is increased or decreased, may be used. This may involve strengthening the various mechanical devices to allow for high travel speeds and for fast acceleration and deceleration. This variation may allow higher processing rates without losing the random look of the product. Other possible methods to accomplish a similar look product may include developing the ability to oscillate the cutter heads, perhaps inclusive of moving the entire drive mechanism, back and forth while keeping the boards traveling in a straight line. Similarly, it could be possible to move the cutter heads up and down to take them in and out of the cut, leaving the bed plates stationary. The use of more than two cutter heads can be incorporated to create a certain look. Tools other than a profiled (or milled to pattern type), multi-knife cutter head may be used.

The board workpieces that can be surface profiled by the present invention can be any material that can be formed in plank, board or sheet form, having a surface region that can be mechanically scraped in accordance with the present invention. The material can be, for example, laminate(s), natural wood, veneer layer(s), or molded resin-lignocellulosic composite planks (e.g., particle board, oriented strand board), or molded polymeric planks, or engineered planks (e.g., plywood). The material can be flooring material from the material mentioned herein. The boards can be rectangular (long boards, square shaped, etc.) or any other shapes having at least two generally parallel opposite sides that can be fenced on the present apparatus. The tongue/groove mechanical click laminate planks can be used. Essentially, any material that has a surface(s) that can be scraped can be used in the present invention. Put another way, any material having one or more scrapable surfaces can be used. The material or boards can be any size, and can be cut to desired length prior to the process, during the process, or after the process of the present invention. Thus, a 4'×8' sheet or larger can be processed in the present invention and then cut to desired lengths, as an option. Or, pre-cut planks of finished size can be processed.

Figure 25:
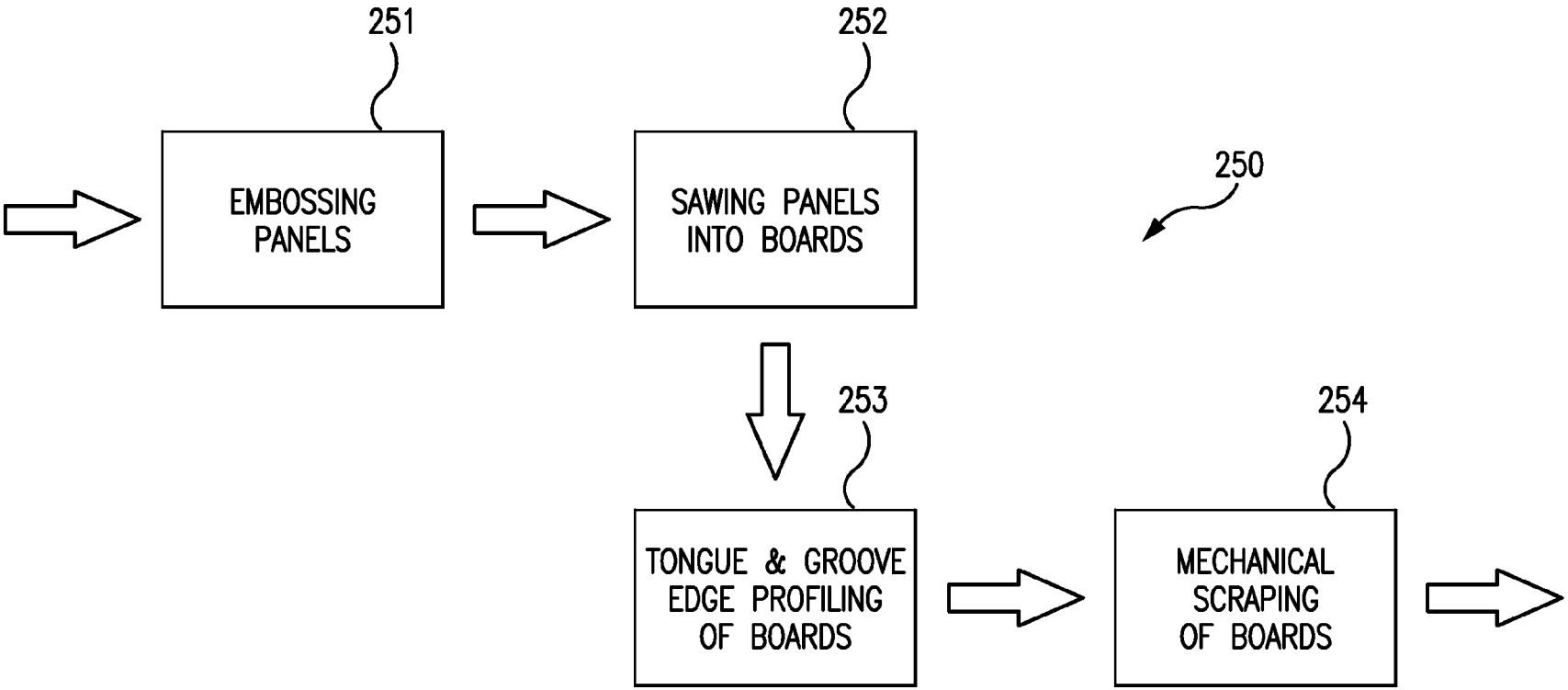
FIG. 25 is one example of a block diagram showing a process for making boards (e.g., flooring boards) with panel embossing, sawing of panels into boards, tongue and groove edge profiling of boards, and mechanical scraping of boards, in accordance with the present invention.

The boards and precursors panel forms of the boards to be scraped can be subjected to additional processing before the mechanical scraping. FIG. 25 shows a process 250 for making flooring boards of the present invention comprising panel embossing (251), sawing of embossed panels into boards (252), tongue and groove edge profiling of boards (253), and the mechanical scraping of boards (254). The arrows show the direction of process flow. Before mechanical scraping, panels can be embossed to impart surface markings in a face ply, such as simulated saw marks, nail and screw marks, wormholes, or any combinations thereof, which can be imparted in addition to the scrapes formed in a subsequent step. Although not limited thereto, the panels can have a size, for example, of approximately 53 inches×44 inches, or other dimensions (a length of 12 inches to 10 ft. or more, a width of 1 inch to 6 ft., or any thickness (1 mm to 200 mm or more)). The embossed panels can be cut into boards having a pair of opposite long edges and a pair of opposite short edges. The panels can be sawed, for example, by passing the panels through a gang rip saw that cuts the panels into multiple boards. The edges of the embossed boards can receive profiles cut into them for providing interlockability with other boards, e.g., tongue and groove profiles. The embossed, tongue-and-groove edge-profiled boards then can be advanced to the mechanical scraping system, such as previously illustrated. The process described in U.S. Published Patent Application Nos. 2009/0159156 and 2007/0209736 can be used along with the present invention and are incorporated in their entirety herein.

The present invention includes the following aspects/embodiments/features in any order and/or in any combination:

1. The present invention relates to a method for imparting a simulated rustic or distressed surface effect in a flooring board comprising:

advancing flooring boards on a table, wherein the table comprises a board supporting surface and a plurality of slot openings in the board supporting surface through which different rotary cutter heads having different cutting profiles protrude to be contactable with lower surfaces of the boards advancing thereover;

engaging opposite lateral sides of the boards with first and second laterally movable fences concurrent with the advancing of the boards on the table;

laterally moving the fences relative to the cutter heads;

engaging lower surfaces of the board with liftable bed plates defining the slot openings in the table as the boards are advanced on the table;

controlling said laterally moving and said liftable bed plates with at least one programmable controller to control the depth of cut and/or lateral cut position on the lower surface of boards, wherein different and at least partial, overlapping patterns of scrapes are formed in the lower surface of the boards by the different cutter heads.

2. The method of any preceding or following embodiment/feature/aspect, further comprising utilizing cam action devices for lifting bed plates relative to the cutter heads and servo motors for driving the cam action devices under control of said programmable controller.

3. The method of any preceding or following embodiment/feature/aspect, further comprising utilizing a servo motor for driving the fence moving under control of said programmable controller 4. The method of any preceding or following embodiment/feature/aspect, wherein the cutter heads comprise different cutting profiles, cutting to different depths, and/or coming into the cut at different frequencies relative to each other to impart a random-looking scraped surface appearance in the lower surface of the board.

5. The method of any preceding or following embodiment/feature/aspect, wherein bearings are mounted in a steel bar and the steel bar is installed under a bed plate wherein the steel bar moves laterally back and forth, wherein the steel bars has an internal thread cut into an end and a threaded rod inserted into the bar threads, and with turning of the threaded rod, the steel bar moves laterally back and forth, wherein pins riding on the bearings raise and lower the bed plate in cam action to lift the plates a predetermined amount relative to the adjacent cutter head.

6. The method of any preceding or following embodiment/feature/aspect, wherein a servo motor drives the steel bar installed under the bed plate used for moving the bed plate vertically up and down at a controllable, variable rate.

7. The method of any preceding or following embodiment/feature/aspect, wherein the fences are bracketed together for joint lateral movement, and first and second connecting bars are both attached to one of the first and second fences and also to first and second jack screw devices, respectively, wherein the first and second jack screws are right angle driven by first and second worm gears, respectively, and the worm gears are driven by shafts connected to a common gear box.

8. The method of any preceding or following embodiment/feature/aspect, wherein a servo motor drives the gear box connected to the shafts driving the jack screws, whereby the fences can be driven laterally back and forth at a controllable, variable rate.

9. The method of any preceding or following embodiment/feature/aspect, wherein the programmable controller uses programming to drive each servo motor axis comprising three parameters to attain the proper movements of the respective moulder elements, comprising the position to which the element travels, the speed at which the element travels to reach the position, and the dwell comprising the time which an element stays at a particular position before moving to the next position.

10. The method of any preceding or following embodiment/feature/aspect, where the three parameters are manipulated independently to set values for position, speed and dwell, wherein the values essentially correspond to a number of encoder pulses generated to produce a specific number of revolutions of the respective servo motors.

11. The method of any preceding or following embodiment/feature/aspect, wherein the programmable controller comprises a random number generator to allow the random selection of a value for each parameter for each movement of an element, wherein any one of the position values is chosen without regard to sequence, and then any one of the speed values is similarly chosen, and finally, in a similar way any one of the dwell values is chosen, and wherein once the three values have been randomly selected, the movement is implemented.

12. The method of any preceding or following embodiment/feature/aspect, wherein the programmable controller comprises a configuration mode wherein the three parameters are treated as a group, wherein each particular position has a specific speed and specific dwell assigned to it, wherein the position is chosen randomly, and once the position is chosen, the speed and dwell are automatically chosen.

13. The method of any preceding or following embodiment/feature/aspect, further comprising board edge bevel cutting means at a slot opening along the table and a servo motor driving the board edge bevel cutting means for beveling opposite edges of the boards.

14. The method of any preceding or following embodiment/feature/aspect, wherein the bevel cutting means imparts different bevel cuts on the opposite sides of the board wherein laterally adjacent bed plate lifters are provided which define the slot opening and are independently lifted relative to the opposite board edges.

15. An apparatus for imparting a simulated rustic or distressed surface effect in a flooring board comprising:

a table comprising a board supporting surface and a plurality of slot openings in the board supporting surface;

first and second laterally movable fences for engaging opposite lateral sides of boards on the table;

a plurality of rotary cutter heads having different cutting profiles and the cutter heads are positioned at different slot openings, wherein each cutter head is fixedly mounted to a rotatable drive spindle, and the cutter head protrudes into the slot opening to be contactable with a lower surface of boards advancing thereover;

liftable bed plates forming portions of the table that define the slot openings;

cam action devices for lifting the bed plates relative to the cutter heads;

a fence moving device for laterally moving the fences relative to the cutter heads;

servo motors for driving the cam action devices and fence moving means;

a programmable controller; and feed rollers for advancing the boards down the table, wherein the programmable controller operable for controlling the servo motors operable that, different and at least partial, overlapping patterns of scrapes are formed in the lower surface of the boards by the different cutter heads.

16. The apparatus of any preceding or following embodiment/feature/aspect, wherein the cutter heads comprise different cutting profiles, cut to different depths, and/or come into the cut at different frequencies relative to each other to impart a random-looking scraped surface appearance in the lower surface of the board.

17. The apparatus of any preceding or following embodiment/feature/aspect, wherein bearings are mounted in a steel bar and the steel bar is installed under a bed plate wherein the steel bar moves laterally back and forth, wherein the steel bars has an internal thread cut into an end and a threaded rod inserted into the bar threads, and by turning the threaded rod the steel bar moves laterally back and forth, wherein pins riding on the bearings raise and lower the bed plate in cam action to lift the plates a predetermined amount relative to the adjacent cutter head.

18. The apparatus of any preceding or following embodiment/feature/aspect, wherein a servo motor drives the steel bar installed under the bed plate used for moving the bed plate vertically up and down at a controllable, variable rate.

19. The apparatus of any preceding or following embodiment/feature/aspect, wherein the fences are bracketed together for joint lateral movement, and first and second connecting bars are both attached to one of the first and second fences and also to first and second jack screw devices, respectively, wherein the first and second jack screws are right angle driven by first and second worm gears, respectively, and the worm gears are driven by shafts connected to a common gear box.

20. The apparatus of any preceding or following embodiment/feature/aspect, wherein a servo motor drives the gear box connected to the shafts driving the jack screws, wherein the fences can be driven laterally back and forth at a controllable, variable rate.

21. The apparatus of any preceding or following embodiment/feature/aspect, wherein the programmable controller uses programming to drive each servo motor axis comprising three parameters to attain the proper movements of the respective moulder elements, comprising the position to which the element travels, the speed at which the element travels to reach the position, and the dwell comprising the time which an element stays at a particular position before moving to the next position.

22. The apparatus of any preceding or following embodiment/feature/aspect, where the three parameters are manipulated independently to set values for position, speed and dwell, wherein the values essentially correspond to a number of encoder pulses generated to produce a specific number of revolutions of the respective servo motors.

23. The apparatus of any preceding or following embodiment/feature/aspect, wherein the programmable controller comprises a random number generator to allow the random selection of a value for each parameter for each movement of an element, wherein any one of the position values is chosen without regard to sequence, and then any one of the speed values is similarly chosen, and finally, in a similar way any one of the dwell values is chosen, and wherein once the three values have been randomly selected, the movement is implemented.

24. The apparatus of any preceding or following embodiment/feature/aspect, wherein the programmable controller comprises a configuration mode wherein the three parameters are treated as a group, wherein each particular position has a specific speed and specific dwell assigned to it, wherein the position is chosen randomly, and once the position is chosen, the speed and dwell are automatically chosen.

25. The apparatus of any preceding or following embodiment/feature/aspect, further comprising board edge bevel cutting means at a slot opening along the table and a servo motor for driving the board edge bevel cutting means for beveling opposite edges of the boards.

26. The apparatus of any preceding or following embodiment/feature/aspect, wherein the bevel cutting means imparts different bevel cuts on the opposite sides of the board wherein laterally adjacent bed plate lifters are provided which define the slot opening and are independently lifted relative to opposite board edges.

27. A method for imparting a simulated rustic or distressed surface effect in a board comprising:

advancing boards on a table, wherein the table comprises a board supporting surface and a two or more slot openings in the board supporting surface through which different rotary cutter heads having different cutting profiles protrude to be contactable with lower surfaces of the boards advancing thereover;

engaging opposite lateral sides of the boards with first and second laterally movable fences concurrent with the advancing of the boards on the table;

laterally moving the fences relative to the cutter heads;

engaging lower surfaces of the board with liftable bed plates defining the slot openings in the table as the boards are advanced on the table;

controlling the liftable bed plates and movable fences with one or more programmable controllers to control the depth of cut and/or lateral cut position on the lower surface of boards, wherein different and at least partial, overlapping patterns of scrapes are formed in the lower surface of the boards by the different cutter heads.

28. An apparatus for imparting a simulated rustic or distressed surface effect in a board comprising:

a table comprising a board supporting surface and a plurality of slot openings in the board supporting surface;

first and second laterally movable fences for engaging opposite lateral sides of boards on the table;

a plurality of rotary cutter heads having different cutting profiles and the cutter heads are positioned at different slot openings, wherein each cutter head is fixedly mounted to a rotatable drive spindle, and the cutter head protrudes into the slot opening to be contactable with a lower surface of boards advancing thereover;

liftable bed plates forming portions of the table that define the slot openings;

a fence moving device for laterally moving the fences relative to the cutter heads;

a programmable controller; and feed rollers for advancing the boards down the table, wherein one or more programmable controllers control the liftable bed plates and the laterally moving fences such that different and at least partial, overlapping patterns of scrapes are formed in the lower surface of the boards by the different cutter heads.

29. A board product of the method of any preceding or following embodiment/feature/aspect.

30. A flooring board comprising a random-looking scraped appearance comprising overlapping multiple scrape patterns.

The present invention can include any combination of these various features or embodiments above and/or below as set forth in sentences and/or paragraphs. Any combination of disclosed features herein is considered part of the present invention and no limitation is intended with respect to combinable features.

Applicants specifically incorporate the entire contents of all cited references in this disclosure. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

Other embodiments of the present teachings will be apparent to those skilled in the art, from consideration of the specification and practice of the present teachings disclosed herein. It is intended that the specification and examples be considered as exemplary only, with the true scope and spirit of the present invention being indicated by the following claims and equivalents thereof.

What is claimed is:

1. A method for imparting a simulated rustic or distressed surface effect in a flooring board comprising:

advancing flooring boards on a table, wherein the table comprises a board supporting surface and a plurality of slot openings in the board supporting surface through which different cutter heads having different cutting profiles protrude to be contactable with lower surfaces of the boards advancing thereover;

engaging opposite lateral sides of the boards with first and second laterally movable fences concurrent with the advancing of the boards on the table;

laterally moving the fences relative to the cutter heads;

engaging lower surfaces of the board with liftable bed plates defining the slot openings in the table as the boards are advanced on the table;

controlling said laterally moving and said liftable bed plates with at least one programmable controller to control at least one of the depth of cut or lateral cut position on the lower surface of boards, wherein different and at least partial, overlapping patterns of scrapes are formed in the lower surface of the boards by the different cutter heads.

2. The method of claim 1, further comprising utilizing cam action devices for lifting bed plates relative to the cutter heads and servo motors for driving the cam action devices under control of said programmable controller.

3. The method of claim 1, further comprising utilizing a servo motor for driving the fence moving under control of said programmable controller

4. The method of claim 1, wherein the cutter heads comprise different cutting profiles, which performs at least one of cutting to different depths, or coming into the cut at different frequencies relative to each other to impart a random-looking scraped surface appearance in the lower surface of the board.

5. The method of claim 1, wherein bearings are mounted in a steel bar and the steel bar is installed under a bed plate wherein the steel bar moves laterally back and forth, wherein the steel bars has an internal thread cut into an end and a threaded rod inserted into the bar threads, and with turning of the threaded rod, the steel bar moves laterally back and forth, wherein pins riding on the bearings raise and lower the bed plate in cam action to lift the plates a predetermined amount relative to the adjacent cutter head.

6. The method of claim 5, wherein a servo motor drives the steel bar installed under the bed plate used for moving the bed plate vertically up and down at a controllable, variable rate.

7. The method of claim 1, wherein the fences are bracketed together for joint lateral movement, and first and second connecting bars are both attached to one of the first and second fences and also to first and second jack screw devices, respectively, wherein the first and second jack screws are right angle driven by first and second worm gears, respectively, and the worm gears are driven by shafts connected to a common gear box.

8. The method of claim 7, wherein a servo motor drives the gear box connected to the shafts driving the jack screws, whereby the fences can be driven laterally back and forth at a controllable, variable rate.

9. The method of claim 1, wherein the programmable controller uses programming to drive each servo motor axis comprising three parameters to attain the proper movements of the respective moulder elements, comprising the position to which the element travels, the speed at which the element travels to reach the position, and the dwell comprising the time which an element stays at a particular position before moving to the next position.

10. The method of claim 9, where the three parameters are manipulated independently to set values for position, speed and dwell, wherein the values essentially correspond to a number of encoder pulses generated to produce a specific number of revolutions of the respective servo motors.

11. The method of claim 9, wherein the programmable controller comprises a random number generator to allow the random selection of a value for each parameter for each movement of an element, wherein any one of the position values is chosen without regard to sequence, and then any one of the speed values is similarly chosen, and finally, in a similar way any one of the dwell values is chosen, and wherein once the three values have been randomly selected, the movement is implemented.

12. The method of claim 9, wherein the programmable controller comprises a configuration mode wherein the three parameters are treated as a group, wherein each particular position has a specific speed and specific dwell assigned to it, wherein the position is chosen randomly, and once the position is chosen, the speed and dwell are automatically chosen.

13. The method of claim 1, further comprising board edge bevel cutting means at a slot opening along the table and a servo motor driving the board edge bevel cutting means for beveling opposite edges of the boards.

14. The method of claim 13, wherein the bevel cutting means imparts different bevel cuts on the opposite sides of the board wherein laterally adjacent bed plate lifters are provided which define the slot opening and are independently lifted relative to the opposite board edges.

15. A method for imparting a simulated rustic or distressed surface effect in a board comprising:

advancing boards on a table, wherein the table comprises a board supporting surface and a two or more slot openings in the board supporting surface through which different cutter heads having different cutting profiles protrude to be contactable with lower surfaces of the boards advancing thereover;

engaging opposite lateral sides of the boards with first and second laterally movable fences concurrent with the advancing of the boards on the table; laterally moving the fences relative to the cutter heads;

engaging lower surfaces of the board with liftable bed plates defining the slot openings in the table as the boards are advanced on the table;

controlling the liftable bed plates and movable fences with one or more programmable controllers to control at least one of the depth of cut or lateral cut position on the lower surface of boards, wherein different and at least partial, overlapping patterns of scrapes are formed in the lower surface of the boards by the different cutter heads.

16. The method of claim 1, wherein said cutter heads are rotary cutter heads.

17. The method of claim 15, wherein said cutter heads are rotary cutter heads.

* * * * *